US006895690B2

(12) United States Patent
Helmer et al.

(10) Patent No.: US 6,895,690 B2
(45) Date of Patent: May 24, 2005

(54) APPARATUS FOR COATING MOVING FIBER WEBS

(75) Inventors: Knut Helmer, Heidenheim (DE); Edwin V. Bowden, West Yorkshire (GB)

(73) Assignee: Voith Paper Patent GmbH, Heidenheim (DE)

( * ) Notice: Subject to any disclaimer, the term of this patent is extended or adjusted under 35 U.S.C. 154(b) by 172 days.

(21) Appl. No.: 10/341,727

(22) Filed: Jan. 14, 2003

(65) Prior Publication Data

US 2003/0154619 A1 Aug. 21, 2003

Related U.S. Application Data

(62) Division of application No. 09/967,154, filed on Sep. 28, 2001, now Pat. No. 6,634,120.

(30) Foreign Application Priority Data

Mar. 26, 2001 (DE) ..... 201 05 252 U
Mar. 26, 2001 (EP) ..... 01107510

(51) Int. Cl.[7] ..... F26B 17/00

(52) U.S. Cl. ..... 34/585; 34/638; 34/639; 34/643

(58) Field of Search ..... 34/585, 611, 614, 34/615, 618, 638, 639, 643

(56) References Cited

U.S. PATENT DOCUMENTS

| | | | | |
|---|---|---|---|---|
| 3,549,070 | A | 12/1970 | Frost et al. | 226/97 |
| 4,848,633 | A | 7/1989 | Hagen et al. | 226/97 |
| 5,230,165 | A | 7/1993 | Beiswanger | 34/60 |
| 5,639,303 | A | 6/1997 | Plomer | 118/218 |
| 5,922,407 | A | 7/1999 | Hess et al. | 427/348 |

FOREIGN PATENT DOCUMENTS

| | | | |
|---|---|---|---|
| DE | 40 29 487 A1 | 4/1991 | D21F/5/00 |
| DE | 295 11 089 | 11/1995 | F26B/13/00 |
| EP | 0 608 206 A1 | 7/1994 | D21H/23/56 |
| EP | 0 770 731 A1 | 5/1997 | D21H/25/06 |
| EP | 0728 285 B1 | 12/1997 | F26B/13/10 |
| WO | WO 98/32921 | 7/1998 | D21H/23/70 |
| WO | WO 98/56985 | 12/1998 | D21F/5/18 |
| WO | WO 99/02773 | 1/1999 | D21F/5/18 |

*Primary Examiner*—Henry Bennett
*Assistant Examiner*—Camtu Nguyen
(74) *Attorney, Agent, or Firm*—Taylor & Aust, P.C.

(57) ABSTRACT

An apparatus for coating a moving web, in particular a paper or cardboard web, on one or both sides with a liquid or pastous coating material includes a coating station for applying the coating material onto the web, as well as a non-contact turning apparatus following the coating station in the moving direction of the web. The web moves in only one plane from the point of exit from the coating station to the point of entry into the non-contact turning apparatus, without changing direction.

17 Claims, 15 Drawing Sheets

APPARATUS FOR COATING MOVING FIBER WEBS

This application is a DIV of 09/967,154 filed Sep. 28, 2001 now U.S. Pat. No. 6,634,120.

BACKGROUND OF THE INVENTION

1. Field of the Invention

The present invention concerns an apparatus for coating one or both sides of a moving fiber web, in particular a paper web or a carton (i.e., cardboard) web, with a liquid or pastous coating material, the apparatus including a coating station for applying a coating onto the web and a non-contact turning apparatus following, viewed in the web's moving direction, the coating station.

2. Description of the Related Art

From WO 98/32921 an apparatus for coating a paper web on one side which includes a coating station and a non-contact turning station is known. After the coating station, in which a coating material is applied onto the moving paper web with the moving paper web being supported by a backing roll, the paper web moves on to a turning roll. From there it travels to a non-contact turning and driving apparatus and moves therethrough. After leaving the non-contact turning and driving apparatus, it is then led to calender-like cylinders which contact and thereby dry the paper web completely. The paper web is then moved on to further processing. In WO 98/32921, for example, an arrangement of four such coating apparatuses in successive sequence is shown, wherein, onto each side of the paper web, a coating material is applied twice. One disadvantage of this prior art coating apparatus is, on the one hand, that the coating is negatively influenced by turning the humid paper web before it has at least partially dried. This disadvantage tends to be even more pronounced since, due to the construction space available, turning rolls with small roll diameters are usually used which leads to a sharp bending of the paper web at the turning point.

In addition, the use of such a turning roll makes it impossible to convert a coating apparatus to an apparatus with which double-coating can be realized since, in this case, the turning roll would be in direct contact with the humid coating which would intolerably influence the coating's quality.

The combination of a non-contact turning apparatus and a non-contact air dryer shown in WO 93/32921, in connection with the non-contact turning and drying apparatus, is, for example, already known from DE 295 11 089 U1. From EP 0 770 731 A1, it is further known to locate a turning apparatus and a drying apparatus under one common housing in order to prevent humid exhaust gas and/or humid exhaust air from escaping into the machine hall.

What is needed in the art therefore is a coating apparatus which at least reduces, if not even eliminates, the risk of quality losses of the coated web.

SUMMARY OF THE INVENTION

This reduction is achieved according to the invention by a coating apparatus in which the web leaves the coating station and enters the non-contact turning apparatus while changing direction in one plane only. This means that the web moves in free motion without applying an external force from the point of leaving the coating station to the point of entering the non-contact turning apparatus, thereby guaranteeing that the coating layer applied onto the web in the coating station can be fixed in the turning apparatus while maintaining the quality obtained in the coating station.

Here, "leaving the coating station" refers to the point at which the web separates from the web guiding element, serving the purpose of directly applying a coating onto the web. Such a guiding element can be, for example, an applicator roll, a support roll or a band endlessly running around a shoe or similar devices. Decisive is that the web's coating condition is changed at the guiding element concerned and, with the exception of some desired drying effects, remains unchanged from the point of separation from it.

When referring to the web entering the non-contact turning apparatus, the point at which the turning apparatus influences the web noticeably, i.e. the point at which gas jets from the turning apparatus or infra-red rays hit the web in such a way that the web's temperature is chanced, is referred to.

In the present invention the length of the web's free motion, i.e. the length of the path of the web between two guiding elements which are in contact with the web, is extended compared with the coating apparatuses known from prior art. This is even more extraordinary since many experts are of the opinion that, with an increase in the length of the free motion, the instability of the web's path also increases and that therefore the expert should be urged to reduce the length of free motions. Surprisingly, the advantageous effects of the present invention can be achieved without taking additional measures or installing further components for increasing the stability of the web's path when moving through the coating apparatus.

In addition to the fact that quality impairing effects on the web during turning are avoided, a further advantage can be achieved by the coating apparatus of the present invention: in contrast to the coating apparatus known from prior art, it is now possible to apply at a coating station a coating material onto both sides of the web because of the planar and externally unaffected path of the web after leaving the coating station. Thus, the space, especially the longitudinal dimension required by the coating apparatuses in which a web is to be double-coated once or several times, can be considerably reduced. This means that valuable construction space can be saved.

The coated web's quality can be further improved by having the web leave the coating station in an upward direction, preferably in an essentially vertical direction. It is often the case that when the web separates, for example, from the applicator roll or a similar coating element used for indirectly applying a coating material onto the web, an effect called "misting," occurs, i.e., a vapour of small coating beads or droplets is formed in the wedge between the web and the surface of the coating element. If the web is, however, leaving the coating station in an upward direction, preferably in an essentially vertical direction, the probability that the small beads fall on the coated web decreases with the increasing pitch angle. The beads are rather more likely to fall back on the coating element instead.

It is, however, also conceivable that the web could leave the coating station in a downward direction. This can be especially helpful in cases where already existing coating apparatuses and/or devices with non-contact turning apparatuses are to be converted in such a way that the web is traveling in one plane only without changing direction between leasing the coating station and entering the non-contact turning apparatus.

As has already been mentioned, the free motion of the web after the coating station serves the purpose of extracting humidity from the web. If the web is leaving the coating station in an upward or downward direction, there is a sufficient path for the web to dry without having to increase the length of the coating apparatus and, with it, its need of space since, in this case, the turning apparatus can be located either essentially above or underneath the coating station.

The non-contact turning apparatus can turn the web by approximately 90°. This is advantageous if web processing units of great length, e.g. a calender, follow the turning apparatus. The web can, for example, leave the coating station in a vertically upward direction, be turned by the turning apparatus by 90° to a machine running direction and then be led back to the height level of the coating station by a vertically arranged calender. In doing so, the available construction space can be used optimally by arranging the web processing units in a compact way. The machine running direction is the direction the web travels, starting with unwinding the web supply to be coated to reeling in the coated web.

In case no further web processing units are to follow the non-contact turning apparatuses, a sufficient drying length can also be obtained by having the web turned by approximately 180° by non-contact turning apparatuses. Use of such a set-up means that about twice the distance between coating station and non-contact turning apparatus is available as drying length.

If only a limited construction height and/or depth (depending on whether the web is leaving the coating station in an upward or downward direction) is available, the required height of the coating station can be reduced if the first turn carried out in the turning apparatus is directed to the machine running direction. If the first turn is in a direction opposite to the machine running direction, the web would inevitably have to be turned again to travel in the machine running direction, a step which could only be carried out above or underneath the first turn of the web.

The above-described turn of the web can be carried out in the turning apparatus in an easy way if the turning apparatus includes a turning unit which is located at the concave side of an turning section of the web. The turning unit can be, for example, a so-called "airturn".

A particularly stable travel of the web which, for example, is desired in cases where the web travels in free motion, can be achieved if the turning apparatus includes a stabilizing unit which is located at the opposite side of the turning unit, on the convex side of the turning section. Such a stabilizing unit can be a non-contact drying unit in the form of a forced convection hood, for example, which will provide the same or differential drying from both sides of the web simultaneously, when considered together with the drying effect of the air turn unit.

A decisive factor of the profitability of, for example, paper or carton processing machines is the speed at which the web to be processed is moving. This moving speed can be increased without impairing the coated web's quality if at least one non-contact drying unit is, viewed in the web's moving direction, located before and/or after the turning unit. In doing so, the drying apparatus' drying performance in relation to the web's path can be increased, thus enabling a reduction of the time the web is in the drying apparatus.

In case the web is double-coated, the length of free motion can be reduced or the moving speed can be increased if at least two non-contact drying units are located opposite each other on different sides of the web. The at least one drying unit can be an air dryer, an infra-red dryer and/or an infra-red pre-heater. It is also possible to use both infra-red dryers and air dryers in the turning apparatus. It can be advantageous to first pre-dry the humid web by means of infra-red rays, thus making the web insensitive to the subsequently impacting air jets or air flows.

Thereafter, the web can be dried by air drying, which due to the turbulences of the air jets near the web's surface, is very homogeneous. It can also be advantageous to first pre-heat the humid web with infra-red rays prior to drying with the impinging air jets, in order to increase the rate of drying under the jets and thereby promote improved final coat quality.

In connection with drying the web to a certain degree and at a certain point of the web's path, it can be desirable to extend the free motion, depending on the degree of the coated web's humidity in order to obtain more time for the web to dry while traveling at constant speed. This can be achieved in a space-saving manner by providing, viewed in the web's moving direction, at least one further non-contact turning unit after a first non-contact turning unit. In addition, at least one of the non-contact turning units can also have a drying function in addition to turning the web. For example, such drying can be achieved by heating the web with a gas which is warmer than the impingement air's ambient temperature and/or increasing the impingement jet velocity of the air turn unit, thereby increasing the Reynolds number of the impingement flow at the product surface. With this turning apparatus, the forced convective drying effect is increased.

As the functions of drying and turnings can be combined in one apparatus, it is also conceivable to construct a combined drying and turning apparatus by constructionally combining a drying unit and a turning unit in one element.

During the drying process of the coated web, the coating, which at first had been applied in a humid or pastous form, emits humidity and/or solvents into the atmosphere which, if mixed with the ambient air in the machine hall, may have a harmful effect on the health and well-being of the personnel working in the machine hall as well as on the building itself. These harmful effects can be avoided if the non-contact turning unit, the at least one further turning unit and/or the at least one non-contact drying unit are located in one common housing which, if desired, can consist of several housing parts. The common housing can, for example, have a suction hood sucking off the humid or/and solvent-containing exhaust gas directly from the area around the web such that it cannot get into the ambient atmosphere of the machine hall.

The coating station used for applying the coating can exhibit at least one coating unit for directly applying the coating material onto the web and/or at least one coating unit for indirectly applying the coating material onto the web. This guarantees a desired coating result taking into consideration the available construction space. If only little space for the coating station is available and if coating on both sides is desired, one side of the web can, for example, be coated indirectly by an applicator roll and the other side can directly be coated by a coating unit, wherein the applicator roll serves as a support roll for the coating unit. In addition, the use of any kind of coating device desired is conceivable, such as coating devices known by experts as JetFlow F, SDTA (Short Dwell Time Applicator). LDTA (Long Dwell Time Applicator), Curtain Coater, etc.

If the web is to be coated in several layers, two or more coating units according to the invention can be arranged in succession in one coating apparatus, wherein each individual coating unit can apply a coating layer on one or both sides of the moving web.

The gas-nozzle arrangements used in turning and drying apparatuses play an important role for the operatability of such coating apparatuses. It is, for example, important that there is a stable air cushion at the turning point of non-contact turning apparatuses, such as airturns. The requirements to be met by such an air cushion and its stability increase with an increasing length of the web's free motion. If an inhomogenity, for example, by a varying degree of the web's humidity in latitudinal direction is to be avoided, a uniform gas distribution over the length of a gas-nozzle arrangement or a gas distributor is also very important. Also of importance in this respect is the distribution, velocity and direction of the air exiting from the air cushion region.

From the prior art WO 98/56985, certain gas distributors used for driving paper webs are known, each of which is essentially made of an elongated hollow body extending in its longitudinal direction perpendicularly to the web's moving direction. This hollow body includes a gas intake and a gas exhaust, wherein the gas exhaust is located at the wall section of the hollow body (gas exhaust section), which is essentially parallel to the web's surface and faces the moving web. The gas distributor of the prior art is characterized in that the introduction of gas 20, takes place at the side wall. The height of the gas-flow relevant cross-section inside the gas distributor decreases linearly from the gas intake side to the side opposite this gas intake side. A disadvantage of this gas distributor is that a homogeneous gas flow over the entire gas distributor's length is not always guaranteed. This circumstance was tried to be compensated by linearly decreasing the gas-flow relevant cross-section, which, however, again due to the asymmetric gas intake from one side wall, leads to an unnecessarily large construction volume of the gas distributor.

In order to save construction space as well as to guarantee a uniform gas discharge over the entire length of the gas distributor, it is suggested in the present invention to use an above-described gas distributor of the generic type whose gas intake is located at the longitudinal center of the hollow body in non-contact turning or/and drying apparatuses for moving webs.

The gas distributor does not necessarily have to extend in its longitudinal direction transversely to the web's moving direction. It can also be arranged parallel to the web's moving direction in its longitudinal direction in order to affect certain zones, such as the web's margin and, for example, to dry them. In addition, it can have any intermediate position desired. This gas distributor has, taken without the coating apparatus described so far, a technical novelty with a value of its own.

Locating the gas intake at the longitudinal center of the elongated hollow body means that the distance from the gas intake point to the most remote gas outlet point is halved, making it more likely that the gas exhaust flow is homogeneous over the entire distributor's length.

A smaller width of the gas distributor, which may be desirable if several gas distributors are to be arranged next to each other in a small space, can be achieved by locating the gas intake at the hollow body's wall section opposite the gas exhaust section.

The elongated hollow body can have various forms. Constructing the hollow body as a hollow parallelepiped body can be a particularly simple and cost-efficient version. However, if the vertical clearance of the gas flow cross-section inside the hollow body starting from a longitudinal center section including the gas intake to the two longitudinal ends of the hollow body decreases and preferably does so continuously, the homogenity of the gas exhaust flow can be increased even further. Advantageously, the vertical clearance of the gas flow cross-section of the hollow body at a certain longitudinal position changes proportional to the amount of gas which is to be emitted at that longitudinal position of the hollow body. As a further measure to increase the homogenity of the discharged gas flow, the hollow body can be symmetric with respect to its longitudinal center plane.

From WO 98/56985 an apparatus for drying a paper web with gas distributors arranged parallel to each other and perpendicular to the web's moving direction under one common gas suction hood is known. However, in the disclosed drying apparatus therein, the gas distributors thereof are supplied with gas from a side wall, leading to an unnecessarily high construction of the drying apparatus.

As already mentioned, the gas distributor of the present invention is particularly suitable for drying and/or turning a moving web within driving or turning apparatuses, in particular in the above-described coating apparatuses. According to the invention, in the turning units at least one gas distributor extends transversely to the web's moving direction. In contrast to the prior art, the above-described drying and/or turning unit of the present invention needs less construction height. A further advantage is that, in case the web is turned, as large of a latitudinal area of the web as possible is supported by an air cushion. Also, if a gas distributor used in a drying unit is arranged in such a way, as large of a latitudinal area of the web as possible can be affected by drying gas.

As already mentioned, the humid or even solvent-containing exhaust gas is to be sucked off the drying and/or turning area in order to avoid possible impairing effects on the personnel within and the structure of the machine hall near the apparatus. These potentially impairing effects can, for example, be minimized if the turning apparatus, in particular a drying or/and turning unit contained in it, includes a gas suction hood which surrounds the at least one gas distributor, the gas suction hood being open in direction towards the web and being connected to at least one gas exhaust line. The at least one gas distributor is then supplied by a gas supply line. An especially safe turning and a homogeneous drying of the web can be achieved if the at least one gas distributor essentially extends over the entire width of the moving web.

If the web's moving speed is to be increased without impairing drying performance and without losing any stability at the turning point, a plurality of gas distributors may be arranged under the gas suction hood parallel to each other and spaced apart in the web's moving direction. Arranging the plurality of gas distributors in such a spaced-apart manner guarantees that the unit is provided with slots or openings through which humid and/or solvent-containing exhaust gas can be sucked off by the gas exhaust line.

In order to keep the effort for processing the gas suction hood as low as possible if several gas distributors are used under one gas suction hood, a central gas supply line can be introduced into the interior of the gas suction hood, wherein advantageously distribution lines inside the gas suction hood would lead from the at least one gas supply line to the individual gas distributors. A single gas supply line is not able to adequately supply an arbitrary number of gas distributors. Depending on the number of distributors, it can therefore be practical to divide the plurality of gas distributors into groups, wherein advantageously one gas supply line and one gas exhaust line are allocated to each group, each such supply line supplying the gas distributors of the corresponding groups with gas and each such gas exhaust line sucking humid and/or solvent-containing exhaust gas of the web's surface.

In case there is only one gas suction point through which gas from a large area, compared to the cross-section of the gas exhaust line, is sucked off, a non-uniform gas exhaust over the area may occur. It may be that sections near the gas exhaust line experience a stronger gas exhaust than sections further away from this opening. Normally, this is undesirable and can be avoided by providing the gas suction hood with a flow equalizing device for the gas flowing from the moving web into the gas suction hood. The flow equalizing device can, for example, exhibit openings which, in part, have differently sized cross-sections in order to provide sectionwise-adapted flow resistances. A flow equalizing effect can, however, already be achieved if the flow equalizing device is able to provide a constant flow resistance over their entire surface. These flow equalizing devices can be achieved in a material-saving manner by arranging them between the gas distributors parallel to the web's surface. Each flow equalizing device can thus be made of various structures having minimized material requirements, such as a perforated plate, flow-permeable bonded fiber fabrics, honeycomb structures, grates or the like.

A further possible reason for an inhomogenity in the gas suction flow can be that the gas exhaust lines used for the individual groups perform differently. This effect can be avoided or at least reduced if flow throttle devices are arranged in the gas suction space between the gas distributor groups in essentially a vertical direction and parallel to the gas distributors. These flow throttle devices extend at least over a part of, cross-section of the gas suction hood and advantageously over the entirety thereof. These flow throttle devices can be conceived as being flow-permeable but having flow-resistive partitions between the individual gas distributor groups. These flow throttle devices can also be made of the above-mentioned structures such as perforated plates, honeycomb structures, grates, flow-permeable bonded fiber fabrics, or the like.

Drying a double-coated moving web is a special technical challenge since from nearly the same material volume twice as much humidity has to be removed per time unit. This challenge can, for example, be solved by arranging at least two drying apparatuses or at least one turning and at least one stabilizing unit opposite to each other on different sides of the moving web. This set-up applies not only to drying but also to turning the web, namely in cases where a particular stability of the web is required, such as in case of long free motions of the web. The at least two drying units or the at least one turning and the at least on stabilizing unit can be arranged in such a way that at least some of the gas distributors are located on both sides of the web at essentially the same longitudinal positions, viewed in the web's moving direction, in pairs opposite to each other. This arrangement has the advantage of being able to dry the web particularly gently since the forces applied on the web by the gas flows compensate each other mutually. A flexing of the web can thus be avoided.

It is, however, also possible to arrange at least some of the gas distributors on one side of the web and at least some of the gas distributors on the other side of the web alternatingly with respect to their longitudinal positions viewed in the web's moving direction. In other words: a first gas distributor is located on one side of the web: and viewed in the web's moving direction, spaced apart from the first gas distributor, another gas distributor is located on the other side of the web, etc. With this arrangement the web may, under certain circumstances, experience flexing. However, this arrangement has the advantage that the web's surface in the drying section is extended by this flexing such that a greater drying performance can be achieved without having to change the construction or running parameters of the drying and/or turning apparatus. It is also possible to arrange some of the gas distributors in one way and some of the other distributors in the other way, i.e. they can be arranged at the same longitudinal positions opposite to each other in some areas and alternatingly in others. This varied arrangement can, for example, be applied at a humid web which had just been coated. This web can initially be guided through an arrangement of alternating gas distributors resulting in the forming of waves on the web, thus increasing its surface. This increased surface increases the drying performance in the drying apparatus and then, with an already pre-dried coating, the web is smoothly moved through the drying apparatus' gas distributors opposite to each other.

Summarizing, the air turn has been specifically designed to ensure that stable support of the moving web occurs by the generation of a pressure support cushion of dynamic air which comes into equilibrium with the operating web tension at the desired flotation height above the air turn surface. The resulting supporting cushion pressure generated has been made to be substantially independent of the impingement velocity at the nozzle exit to ensure high heat and mass transfer rates are achievable. This situation is brought about by varying the pressure of the as inside the air turn elements in order to attain the requisite impingement gas velocity at the web surface. The desired web flotation height meanwhile is maintained by regulating the velocity of air exiting the pressure cushion region by ensuring that it flows through a variable gas distributor positioned between the impingement elements located parallel to the web surface. By use of such a device, the distribution of the air exiting from the cushion pressure region is also distributed evenly across the width of the unit while being maintained at the desired cushion pressure level.

Advantageously, nozzle systems as described in EP-B 1-0 728 285 may be used, the disclosure of which document hereby is incorporated into the present application by reference. By using such nozzle systems, it is possible to substantially shorten the drying lengths required and, hence, the space taken up in the machine running direction by the overall apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
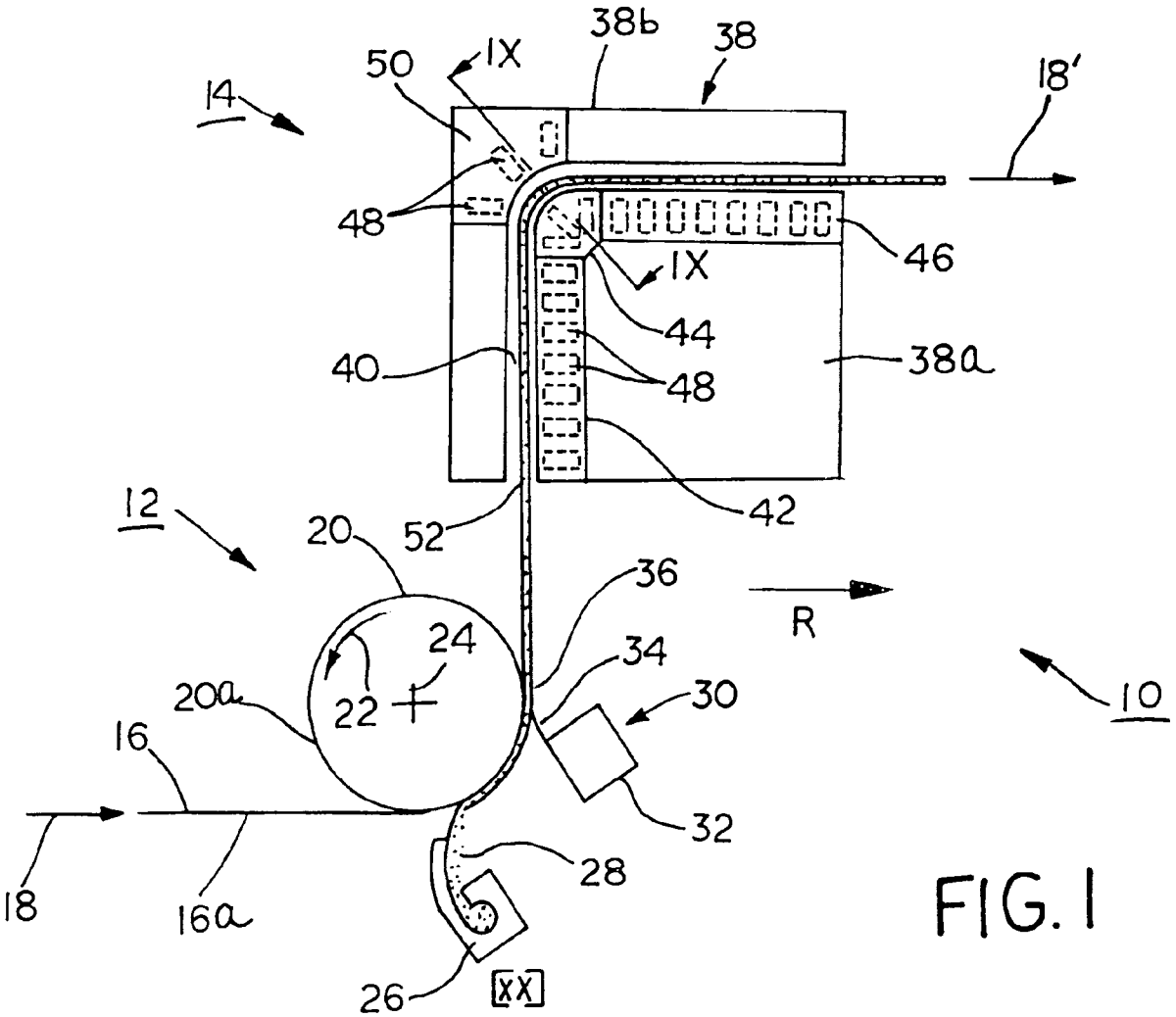
FIG. 1 is a schematic cross-section of a coating apparatus in accordance with the present invention, wherein the web is coated on one side and is turned in the turning apparatus by 90°.

In FIG. 1 a coating apparatus 10 includes a coating station 12 as well as a non-contact turning apparatus 14. A web 16 moves into coating station 12 in the direction of arrow 18.

Coating station 12 includes a support element in form of a support roll 20 which rotates in the direction of arrow 22 around axis 24 thereof, axis 24 being perpendicular to the drawing plane of FIG. 1 in such a way that web 16 is supported slip-free by circumference 20*a* of support roll 20.

Coating station 12 further includes a coating unit 26 from which a liquid coating material 23 is directly applied onto side 16*a* of web 16 not facing support roll 20. In the moving direction 18 of web 16, after coating unit 26, an equalizing apparatus 30 is provided. Equalizing apparatus 30 includes a stiff beam 32 on which a doctor blade 34 is mounted for metering and equalizing liquid coating 28 applied onto web 16. In the moving direction 18 of web 16, web 16, now layered with coating 28, separates from support roll 20 at a point 36 after having passed the tip of doctor blade 34. Point 36 refers to the point at which web 16 leaves coating station 12. At point 36 the process of applying coating 28 is quantitatively and qualitatively terminated, with the exception of unavoidably beginning drying processes due to convection. In addition, there is no possibility for any element or component designed to directly apply a coating 28 onto web 16 to have an effect on web 16 after web 16 has passed leaving point 36. Further, from point 36 the free motion of web 16 begins and continues until web 16 is again in contact with a guiding and/or directing element (not shown in FIG. 1).

Non-contact turning apparatus 14 includes a housing 38 which is composed of a first housing part 38*a* and a second housing part 38*b*. Between housing parts 38*a* and 38*b*, a gap 40 is provided in which web 16 travels. In first housing part 35*a*, which is on the concave side of web 16 in moving direction 18 thereof, there is a drying unit 42 on the entering side, a turning unit 44, and a drying unit 46 on the exit side. Both drying units 42 and 46 as well as turning unit 44 are comprised of gas distributors 48 arranged transversely to moving direction 18 of web 16 (i.e., perpendicular to the drawing plane of FIG. 1) whose cross-sectional outline is shown in broken lines in FIG. 1. Warm air is conducted by gas distributors 48 against humid side 16*a* of web 16, onto which coating 28 was applied, in order to turn web 16 and/or to extract humidity therefrom. First housing part 38*a* further includes an exhaust apparatus (not shown in FIG. 1) for conducting the humid exhaust air away from the area near side 16*a* of web 16.

In second housing part 38*b*, which is located at the convex side of web 16 and in a radial direction opposite to turning unit 44, a stabilizing, unit 50 is provided. Stabilizing unit 50 also includes gas distributors 43 arranged transversely to moving direction 18 of web 16. Gas distributors 48 of stabilizing unit 50 blow air towards web 16. Stabilizing unit 50 serves the purpose of providing a stable guidance for web 16 in turning section 44 and of pressing web 16 against an air cushion formed by turning unit 44, thus facilitating long free motions of web 16. A turn by 90° in machine running direction R takes place in non-contact turning apparatus 14. As a result, non-contact turning apparatus 14 can be formed with a comparatively low construction height.

Coated web 16 enters non-contact turning apparatus 14 at point 52. Entering point 52 is the beginning of gap 40, since here begins, viewed in moving direction 18 of web 16, the area in which drying apparatus 42 at the entering side can significantly affect web 16.

Between points 36 and 52, web 16 moves essentially in one plane which contains points 36 and 52 and which, in the example shown in FIG. 1, is perpendicular to the drawing plane. Web 16 is not affected mechanically between leaving coating station 12 and entering non-contact turning apparatus 14, whereby the risk of impairing web coating 28 is reduced or even avoided. The quality of coating 28 can thus be guaranteed or even increased.

Figure 2:
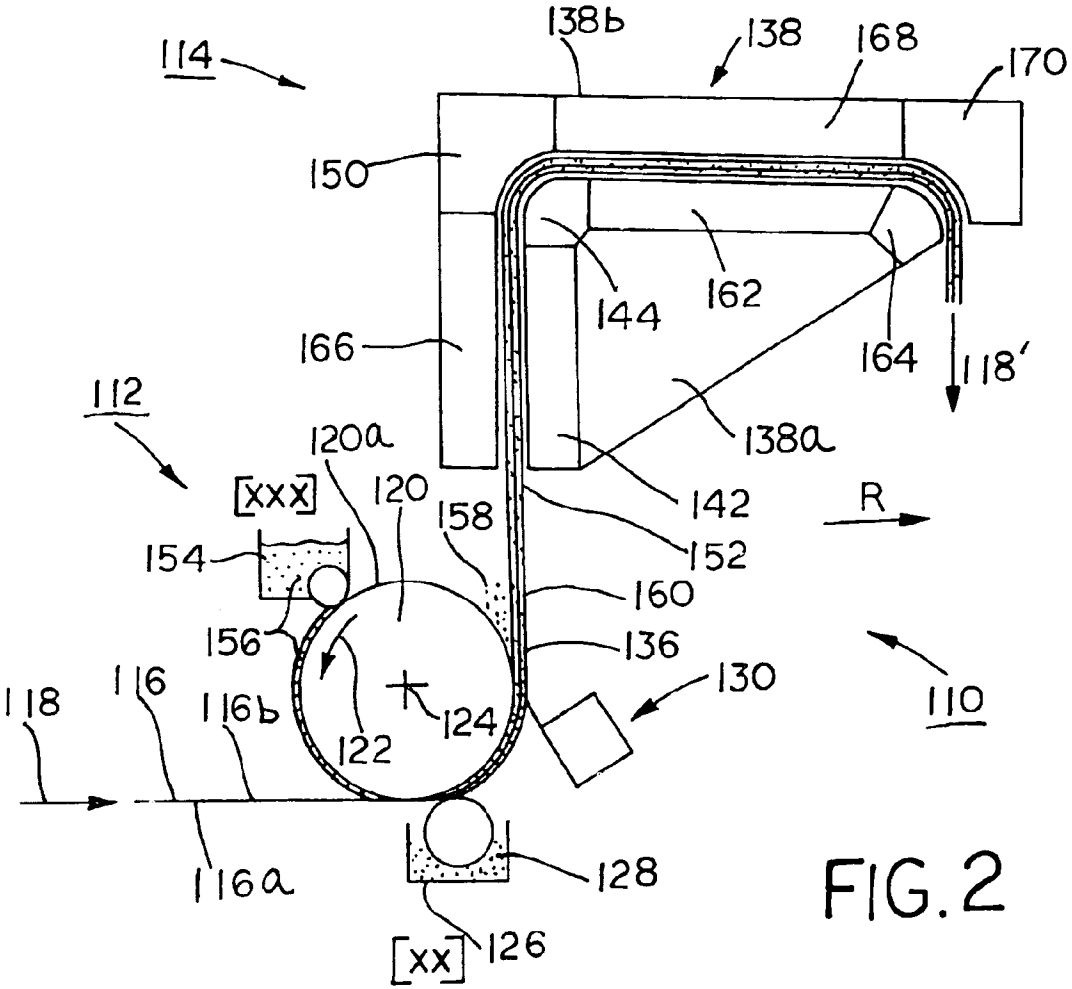
FIG. 2 is a schematic cross-section of a coating apparatus in accordance with the present invention, wherein the web is double-coated and is turned in the turning apparatus by 180°.

In FIG. 2 the same components as in FIG. 1 are marked with the same reference numbers, however, increased by 100. It is herewith explicitly referred to the description of FIG. 1.

In FIG. 2 a web 116 enters a coating station 112 in the direction of arrow 118. Coating station 112 serves the purpose of double-coating web 116. Combined support and applicator roll 120 rotates in direction of arrow 122 around turning axis 124 thereof, turning axis 124 being perpendicular to the drawing plane in such a way that no relative movement occurs between circumference 120*a* and web 116.

On side 116*a* of web 116 facing away from circumference 120*a*, a coating 128 is applied by a direct-application coating unit 126 as shown in FIG. 1. In moving direction 118 of web 116, following first coating unit 126, an equalizing apparatus 130, as shown in FIG. 1, is provided. In addition, coating station 112 includes a further coating unit 154. Second coating unit 154 applies a coating 156 first onto circumference 120*a* of combined support and applicator roll 120, from which coating 156 is then applied onto side 116*b* of web 116 facing circumference 120*a*. Depending on the target to be met by coating 156, liquid coating 128 and coating 156 can be composed of the same or different coating materials.

At leaving point 136 at which humid web 116 coated on both sides with coatings 128 and 156 separates from combined support and applicator roll 120, web 116 leaves coating station 112 according to the definition in a vertical direction. Having web 116 leave combined support and applicator roll 120 in a vertical direction is of advantage since beads 158 of coating 156 which can form in wedge 160 between applicator roll 120 and web 116 are very likely to fall onto roll 120 rather than on web 116. This relationship between web 116 and roll 120 remarkably increases the coating results.

At point 152, web 116 enters non-contact turning apparatus 114. Web 116 moves in one plane without changing direction between points 136 and 152.

Non-contact turning apparatus 114 turns web 116 by 180° in total, i.e. at two points by 90° each. Web 116 leaves non-contact turning apparatus 114 in the direction of arrow 118'. Turning apparatus 114 exhibits a housing 138 with a first housing part 138*a* located on the concave side of turned web 116 (=side 116*a* in FIG. 2) and a second housing part 138*b* on the convex side of turned web 116 (=side 116*b* of web 116). In first housing part 138*a* in moving direction 118 of web 116, there is a first drying unit 142 at the entering side, a first turning unit 144, a further drying unit 162 on the concave side and a second turning unit 164. In contrast, second housing part 138*b*, also viewed in moving direction 118 of web 116, exhibits a second drying unit 166 on the entering side, a first stabilizing unit 150, a further drying unit 168 on the convex side and a second stabilizing unit 170. By arranging drying units 142, 162, 166 and 168; turning units 144 and 164; and/or stabilizing units 150 and 170, which can be run with warm or hot gas and thus also be used for drying web 116, on both sides 116*a*, 116*b* of web 116, a long free motion of web 116 and an accordingly good drying effect can be realized, due to the U-shaped path traveled by web 116, without having to occupy unnecessary space in the machine hall. This arrangement decreases, for example, the expenses for the space occupied by drying apparatus 110.

The schematically-shown drying units 142, 162, 166, 163 shown in FIG. 2 are infra-red drying units. They can, however, also be gas and/or air drying units as in FIG. 1.

Figure 3:
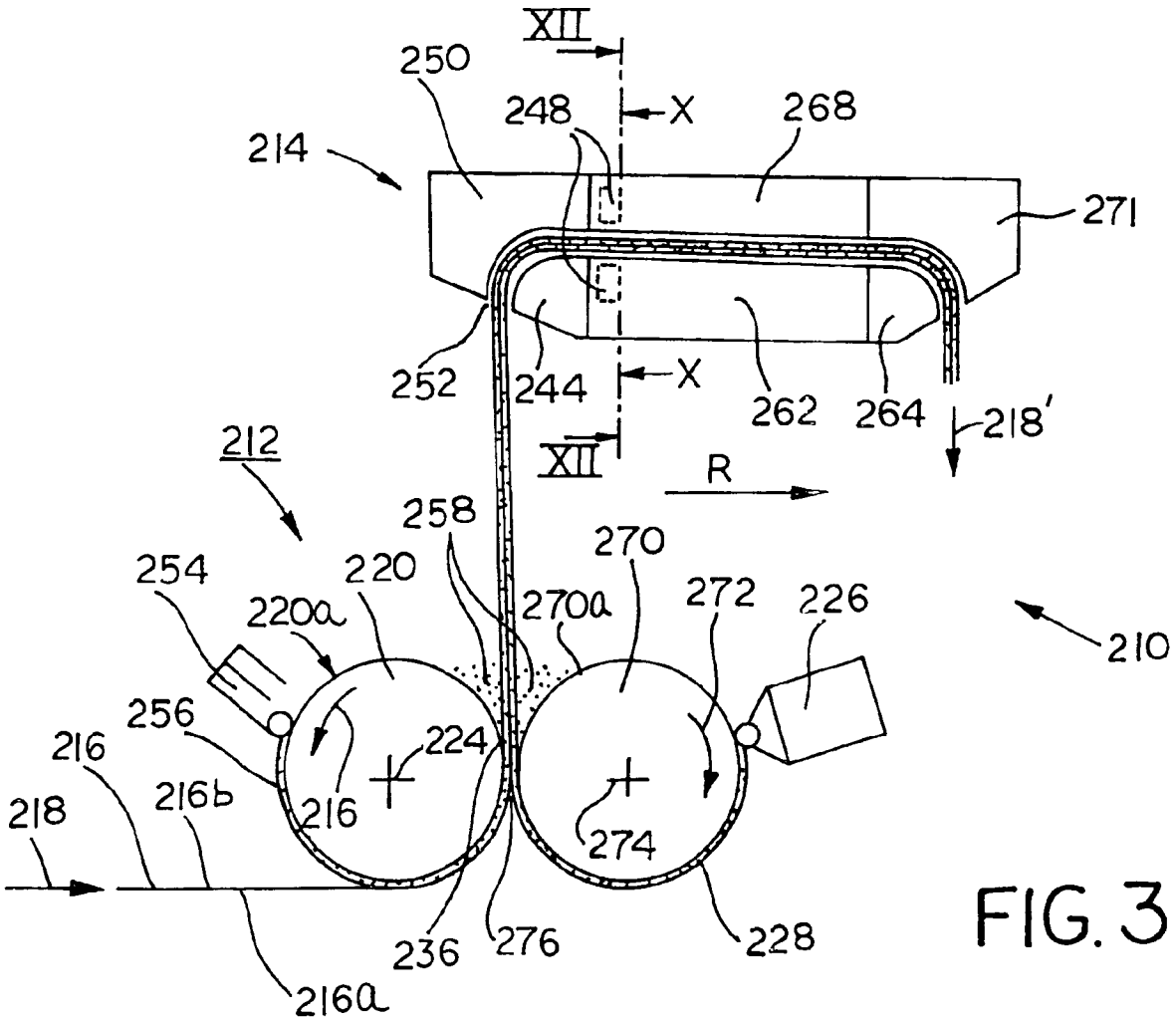
FIG. 3 is a schematic cross-section of a further embodiment of the coating apparatus of the present invention.

In FIG. 3 the same components as in FIG. 2 are marked with the same reference numbers, however, increased by 100. In the following FIG. 3 is only described insofar as it differs from the FIGS. 1 and 2. For the other components it is herewith referred to the descriptions of FIGS. 1 and 2.

In FIG. 3 a web 216 is coated by of indirectly applying a coating 228 on side 216*a* thereof by an applicator roll 270. Likewise, coating 256 is applied on side 216*b* of web 216 by an applicator roll 220. Turning axis 274 of applicator roll 270 is parallel to turning axis 224 of applicator roll 220. Applicator rolls 220 and 270 rotate around their respective axes in the direction of arrows 222 and 272, respectively, in such a way that no relative motion between web 216 and circumferences 220*a* and 270*a* of applicator rolls 220 and 270 takes place at pressing nip 276 which is provided for applying coating 228 and 256 from applicator rolls 220 and 270 onto web 216.

As shown in FIG. 3, point 236 at which web 216 leaves coating station 212 is, viewed in moving direction 218 of web 216, a little behind pressing nip 276, which lies in the plane connecting both turning axes 224 and 274. This situation exists because of the delayed detachment of web 216 from one of applicator rolls 220 and 270 due to adhesion effects of humid web 216.

Due to the indirect double-coating with coatings 228 and 256 onto both sides 216*a* and 216*b* of web 216, a misting occurs after web 216 separates from applicator rolls 220 and 270. Again, the quality of the application and the coating of the web 216 can be guaranteed by stripping web 216 off in a vertical upward direction such that coating particles 158 are less likely to fall back on coated web 216.

At point 252, coated web 216 enters non-contact turning apparatus 214. Housing 238 of non-contact turning apparatus 214 is a gas suction hood allocated to individual turning and drying units 244, 264, 242, 262, 266 and 268. Web 216 is turned in non-contact turning apparatus 214 by 180° in total. In turning apparatus 214 on the concave side of the U-shaped path of web 216 are, viewed in moving direction 218 of web 216, a turning unit 244' at the entering side, a drying unit 262 on the concave side and a turning unit 264 on the exit side. On the convex side of the U-shaped path of web 216, there is a stabilizing unit 250 on the entering side, a drying unit 268 on the convex side and a stabilizing unit 271 on the exit side (also viewed in moving direction 218). All components are run with gas, to be more precise with air. However, it is also conceivable to use gases other than air, such as nitrogen or carbon dioxide. In contrast to the example shown in FIG. 2, drying units 262 and 268 opposite to each other on different sides of web 216 have the same length.

Web 216 travels in one plane between points 236 and 252.

Figure 4:
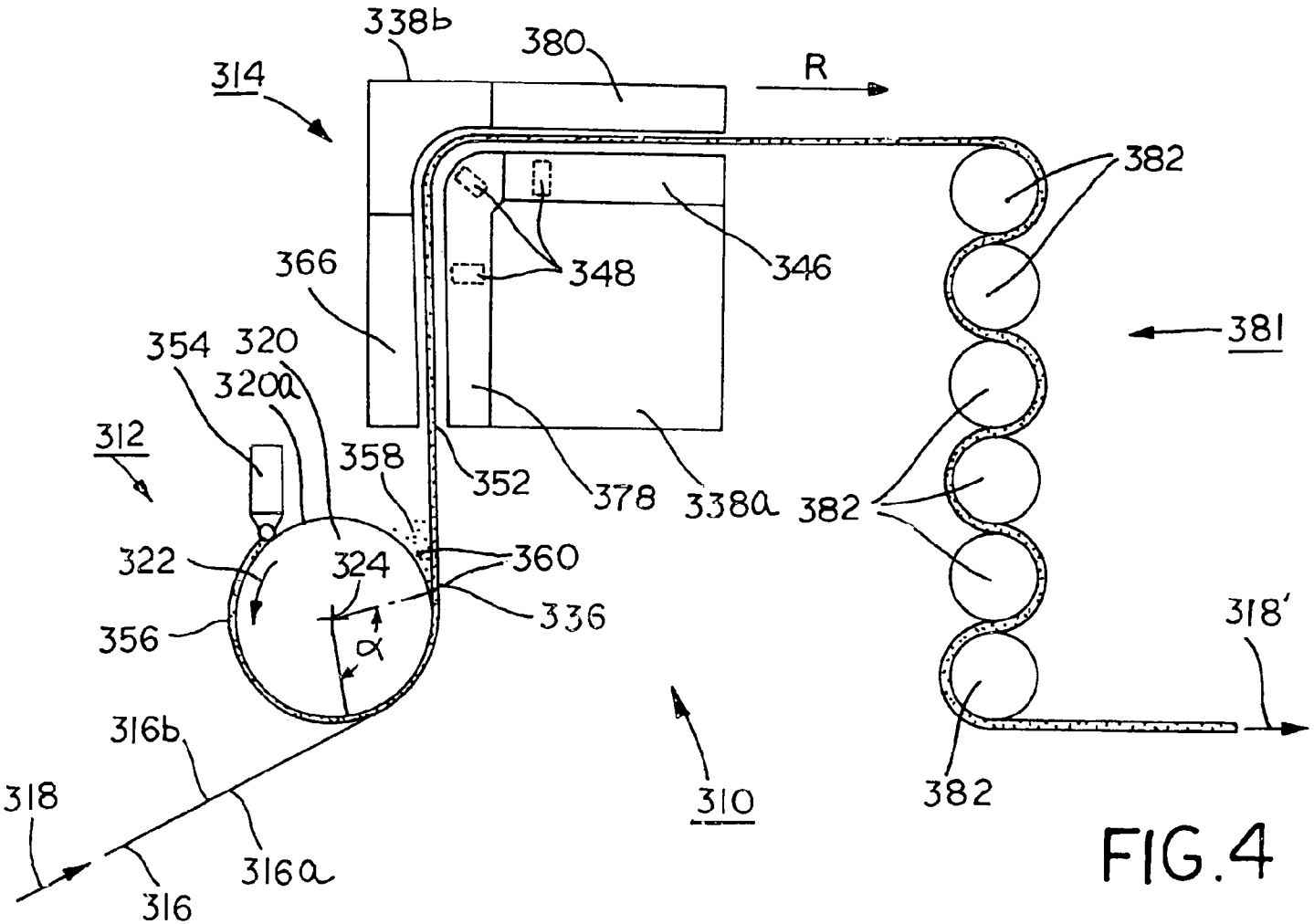
FIG. 4 is a schematic cross-section of a coating apparatus of the invention with a following calender.

In FIG. 4 the same components as in FIG. 3 are marked with the same reference numbers, however, increased by 100. FIG. 4 is only described insofar as it differs from the FIGS. 1–3. For the other components, it is herewith referred to the descriptions of FIGS. 1–3.

A coating 356 is indirectly applied onto side 316*b* of web 316 facing applicator roll 320 by a coating unit 354. Web 316 enters coating station 312 in the direction of arrow 318 from diagonally therebelow and leaves therefrom at point 336. Angle of contact a at which web 316 is in contact with circumference 320*a* of applicator roll 320 can be reduced by having web 316 enter from diagonally therebelow. The optimal angle of contact $\alpha$ can have different values depending on the running and material parameters such as moving speed of web 316 and coating 328 and/or 356 and the coating material used.

At point 352, web 316 enters non-contact turning apparatus 314 after having traveled in one plane from point 336, at which web 316 leaves coating station 312, to point 352. Web 316 is turned by 90° in turning apparatus 314. First housing part 338*a*, facing side 316*a* (the concave side of web 316), relative to moving direction 313 of web 316, includes a combined drying and turning unit 378 followed by a further drying unit 346 on the concave side. Both combined drying and turning unit 378 and further drying unit 346 on the concave side are provided with gas distributors 348 (which are shown in broken lines) and are run with gas having a higher temperature than the ambient air in order to achieve a drying effect.

Combining a drying unit with a turning unit in one single component 373 facilitates the assembly of non-contact turning apparatus 314 considerably since the number of components to be assembled is reduced.

In second housing part 338*b*, which is associated with side 316*b* of web 316, there are provided a drying unit 366 on the convex entering side and a drying unit 380 on the convex exit side. Drying units 366 and 380 serve the purpose of directly drying coating 356 on web 316. Structural components 346 and 37S in first housing part 338*a* serve to change the web's direction in turning section 344, to stabilize the web's path and to indirectly dry web 316 in its straight sections.

After leaving non-contact turning apparatus 314, web 316 enters a vertically arranged calender 381 in which web 316 embraces the halves of six rolls 382, alternatingly, which are arranged parallel to and one below the other. Web 316 is then guided back to the height level at which it entered coating station 312. Web 316 leaves calender 381 in the direction of arrow 318'.

Figure 5:
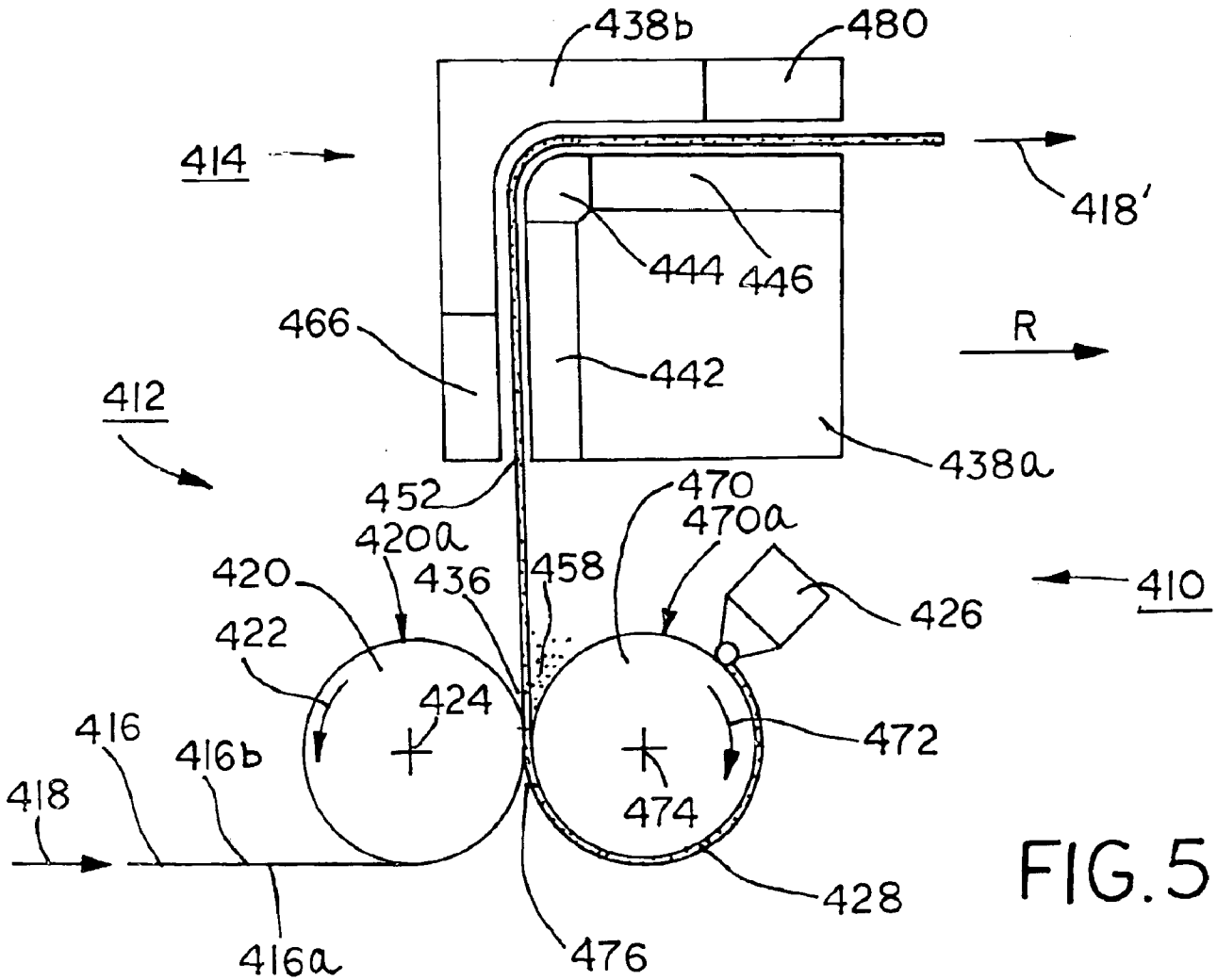
FIG. 5 is a schematic cross-section of a further embodiment of the coating apparatus of the present invention, wherein the web is coated on one side and turned in the turning apparatus by 90°.

In FIG. 5 the same components as in FIG. 4 are marked with the same reference numbers, however, increased by 100. FIG. 5 is only described insofar as it differs from the description of FIGS. 1–4. For the other components, it is explicitly referred to the descriptions of FIGS. 1–4.

Web 416 enters coating station 412 in the direction of arrow 418. Coating station 412 includes an applicator roll 470 and a support roll 420. Applicator roll 470 and support roll 420 rotate in opposite directions in such a way that the speeds of circumferences 420*a* and 470*a* of support roll 420 and applicator roll 470, respectively, as well as that of web 416 are equal. Onto side 416*a* of web 416 a liquid coating 428 is indirectly applied by a coating unit 426 via circumference 470*a* of applicator roll 470. The coating step takes place at pressing nip 476, which lies in the plane including parallel turning axes 424 and 474 of applicator roll 470 and support roll 420, respectively. Web 416 leaves coating station 412, viewed in moving direction 413 of web 416, after pressing nip 476, as has already been explained with respect to FIG. 3. After having passed point 436, web 416 travels in one plane to at least to point 452 at which web 416 enters non-contact turning apparatus 414. In contrast to turning apparatus 314, turning apparatus 414 does not include a combined drying and turning unit 373 at concave side 416*a* of web 416 but includes an individual drying unit 442 on the entering side, a turning unit 444 and, following, a drying unit 446 on the exit side (viewed in moving direction 418 of web 416). In addition, second drying unit 466 on the entering side as well as drying unit 480 on convex entering side of web 416 located in second housing part 438*b* facing convex side 416*b* of web 416 are shorter than those described in FIG. 4. This length reduction is due to the fact that side 416*b* of web 416, to which drying units 466 and 480, on convex side 416*b* are allocated, is not coated and, thus, need not be directly dried. Drying units 466 and 480 on convex side 416*b* rather serve the purpose of stabilizing web 416 and, in addition, of indirectly drying coating 428 applied onto side 416*a* of web 416. Web 416 leaves non-contact drying apparatus 414 in the direction of arrow 418'.

Figure 6:
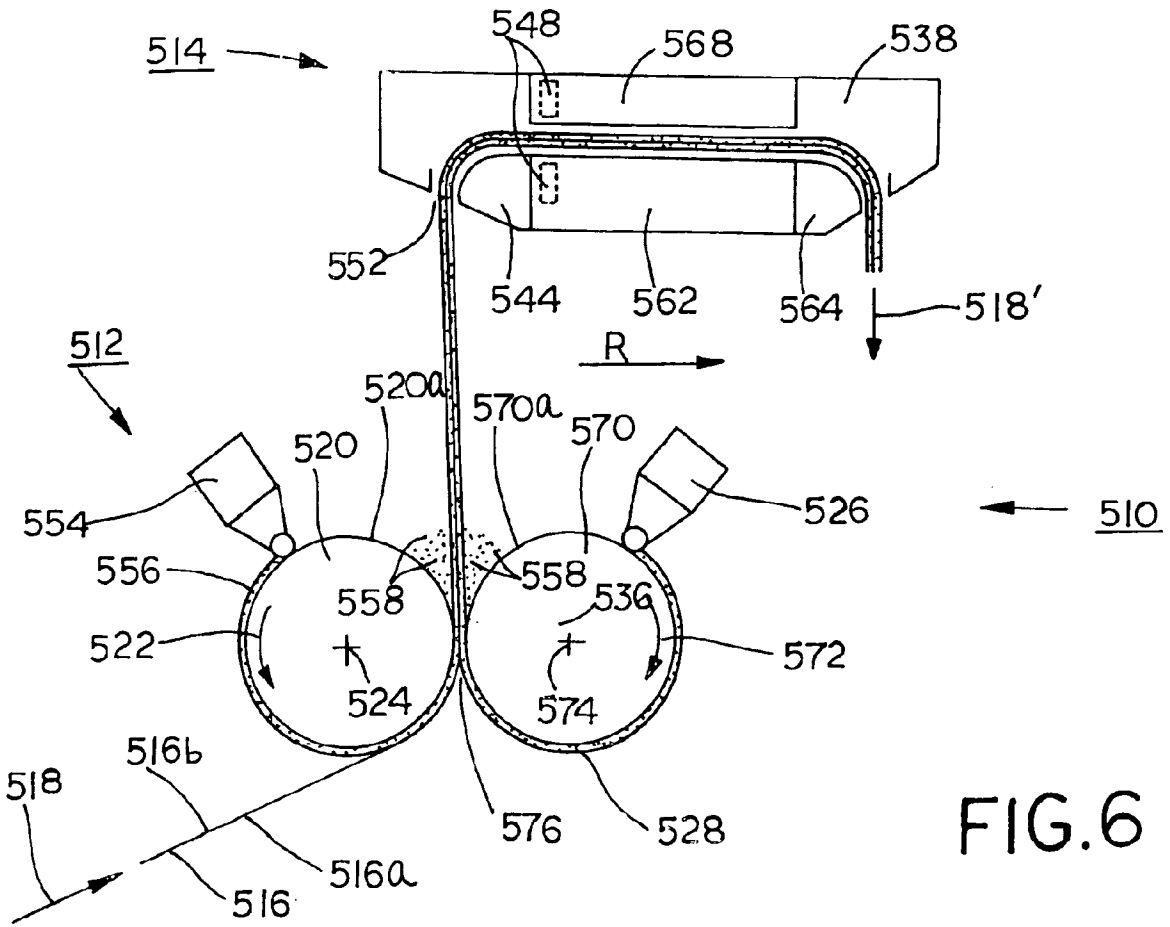
FIG. 6 is a schematic cross-section of a further embodiment of the coating apparatus of the present invention, wherein the web is double-coated and turned in the turning apparatus by 180° C.

In FIG. 6 the same components as in FIG. 5 are marked with the same reference numbers, however, increased by 100. FIG. 6 is only described insofar as it differs from the description of FIGS. 1–5. For the other components, it is explicitly referred to the descriptions of FIGS. 1–5.

In FIG. 6 web 516 enters coating station 512 from diagonally therebelow in the direction of arrow 518. A coating 528 and 556 is indirectly applied onto web 516 via two applicator rolls 520 and 570 by coating stations 526 and 554, respectively. The rotations of applicator roll 520 in the direction of arrow 522, of applicator roll 570 in the direction of arrow 572 and the path of web 516 are coordinated in such a way that there is no relative movement between circumferences 520*a* and 570*a* and between circumferences 520*a* and 570*a* and web 516. Coatings 528 and 556 are applied onto web 516, and, to be more precise, onto both sides 516*a* and 516*b* of web 516 at pressing nip 556. At point 536, web 516 leaves coating station 512 and travels in one plane until entering non-contact turning apparatus 514 at point 552. Turning apparatus 514 essentially corresponds to turning apparatus 214 of FIG. 3. However, non-contact turning apparatus 514 includes, at least on the convex side of the turn, a housing 538 in which a drying unit 568 is arranged. In contrast to turning apparatus 214 of FIG. 3, turning apparatus 514 of FIG. 6 does not include any stabilizing units. Neither turning units 544 and 564 arranged at concave side 516*a* of web 516 nor drying unit 562 are located in a further housing. Each such unit 544, 562 and 564 is a gas suction hood. Turning units 544 and 564 as well as drying units 562 and 568 of turning apparatus 514 are run with air. The provision of such air is shown by two gas distributors 54S in broken lines.

Web 516 leaves non-contact turning apparatus 514 in the direction of arrow 518', i.e. vertically downwards.

Figure 7:
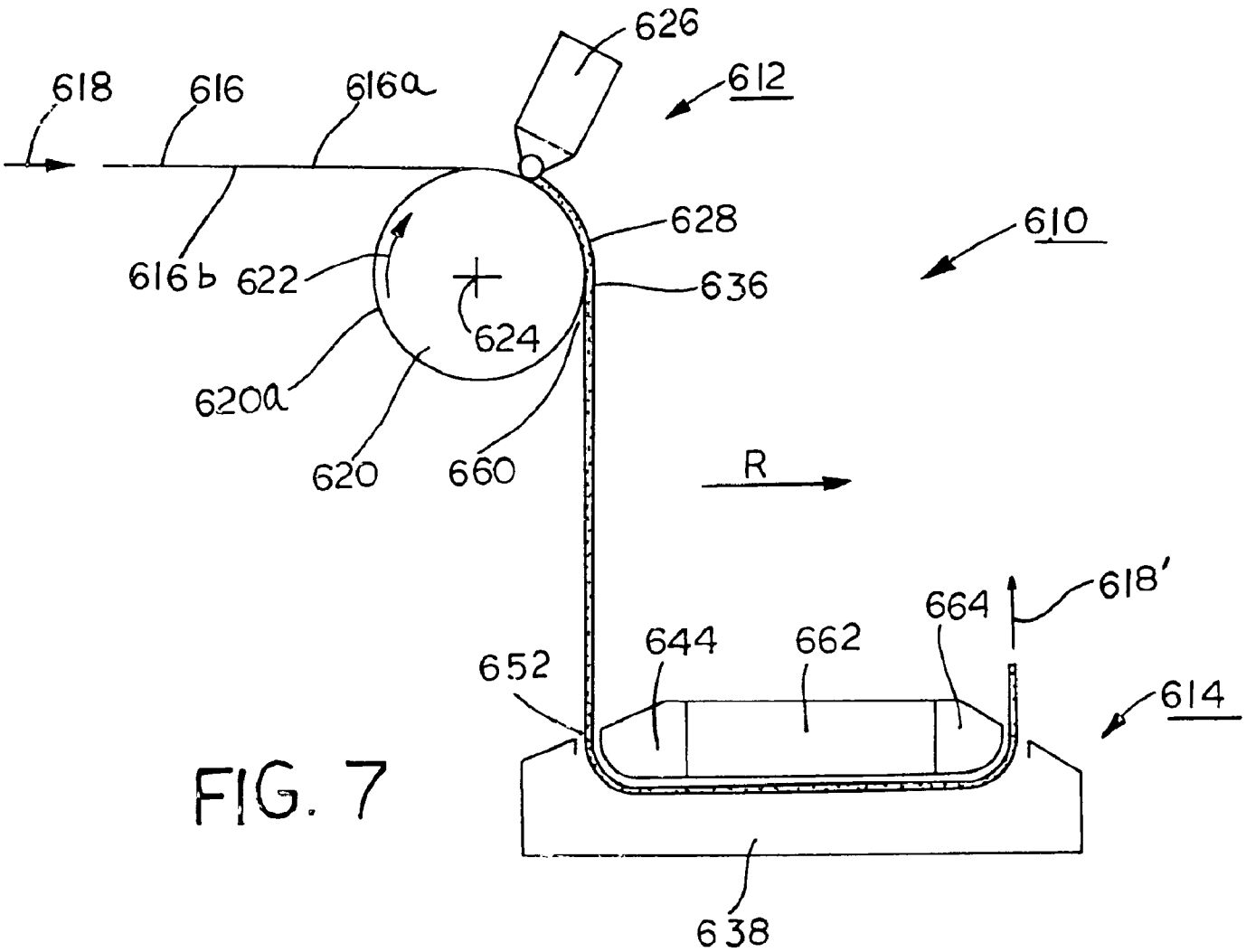
FIG. 7 is a schematic cross-section of a further embodiment of the coating apparatus of the present invention, wherein the Web is coated on one side and leaves the coating station in a vertically downward direction.

In FIG. 7 the same components as in FIG. 6 are marked with the same reference numbers, however, increased by 100. FIG. 7 is only described insofar as it differs from the description of FIGS. 1–6. For the other components, it is explicitly referred to the descriptions of FIGS. 1–6.

In FIG. 7 a web 616 enters coating station 612 in the direction of arrow 618. Web 616 travels around a support roll 620 rotating around turning axis 624 thereof in the direction of arrow 622 without any slip. A coating 628 is thereby applied onto side 616*a* of web 616 facing away from support roll 620 by a coating unit 626. At point 636 web 616 separates from outer circumference 620*a* of support roll 620 and leaves coating station 612 in a vertically downward direction. Web 616 moves in one plane from point 636 to a point 652 at which it enters non-contact turning apparatus 614.

Turning apparatus 614, which turns web 616 by 180° in total (done in two steps of 90° each), includes, on concave side 616*a* of web 616 and in moving direction 618 thereof, a turning unit 644 on the entering side, a drying unit 662 on concave side 616*a* and a turning unit 664 on the exit side. Convex side 616*b* is merely covered by one housing 638 serving the purpose of preventing humid or solvent-containing gases or vapours from escaping into the machine hall. Turning units 644 and 664 as well as the drying unit 66' are run with air which is warmer than the ambient air of the machine hall.

The embodiment of a coating apparatus 610 as shown in FIG. 7 is chosen if, for example, an already existing paper processing machine is to be equipped with a coating apparatus of the present invention and if there is no construction space available above coating station 612.

Figure 8:
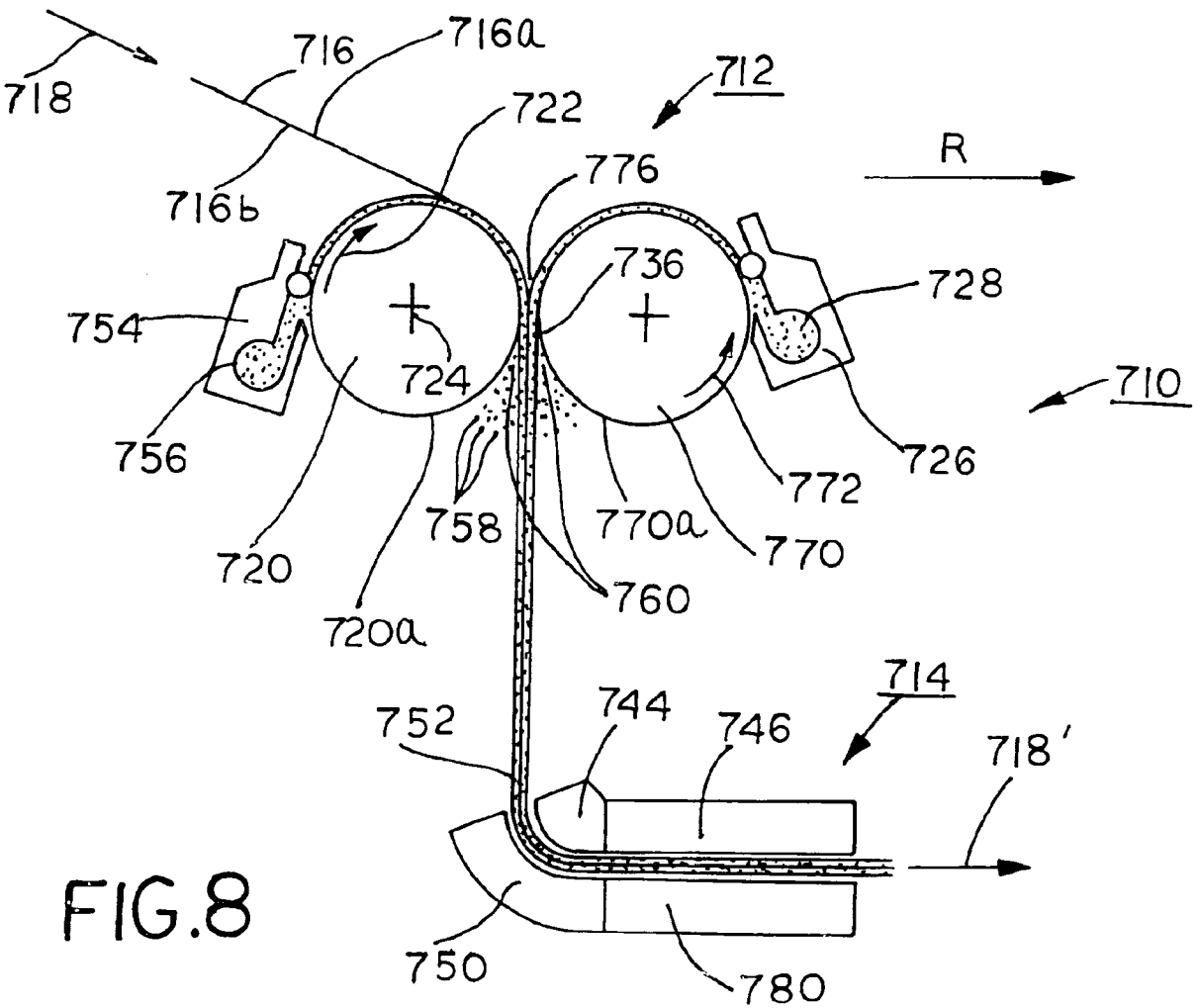
FIG. 8 is a schematic cross-section of a further embodiment of the coating apparatus of the present invention, wherein the web is double-coated and leaves the coating station in a vertically downward direction.

In FIG. 5 the same components as in FIG. 7 are marked with the same reference numbers, however, increased by 100. FIG. 8 is only described insofar as it differs from the description of FIGS. 1–7. For the other components, it is explicitly referred to the descriptions of FIGS. 1–7.

FIG. 8 also shows a coating apparatus 710 where web 716 leaves coating station 712 at point 736 in a vertically downward direction. A coating 728 is applied onto side 716*a* of web 716, side 716*a* facing away from combined applicator and support roll 720. Coating 728 is applied by a coating unit 726 via applicator roll 770. A coating 756 is indirectly applied onto other side 716*b* by a coating unit 754 via applicator roll 720. In moving direction 718 of web 716, a misting in the form of coating particles 758 occurs in wedges 760 behind point 736 and between rolls 720 and 770 and web 716. Coating particles 758 endanger the desired coating quality since they fall down due to gravity and may land on web 716. If desired, a suction hood (not shown in FIG. 8) can be mounted on both sides of web 716 near point 736, removing coating particles 758 before having a chance to land on web 716.

Web 716 travels in one plane from point 736 to point 752, at which web 716 enters non-contact turning apparatus 714. In non-contact turning apparatus 714, web 716 is turned by 90° in machine running direction R. For this purpose a turning unit 744, run with air, is arranged on concave side 716*a* of web 716 and is followed by an infra-red drying unit 746. Opposite turning unit 744, i.e. on convex side 716*b* of web 716, there is a stabilizing unit 750, also run with air, and an infra-red drying unit 750 on the convex exit side of web 716 following thereafter. Turning unit 744, stabilizing unit 750 and infra-red drying units 746 and 780 are not covered by further housings or protective covers. The gas suction hoods allocated to the respective components are sufficient to suck off humid or/and solvent-containing exhaust as or exhaust air. Web 716 leaves non-contact turning apparatus 714 in the direction of arrow 718'.

Figure 9:
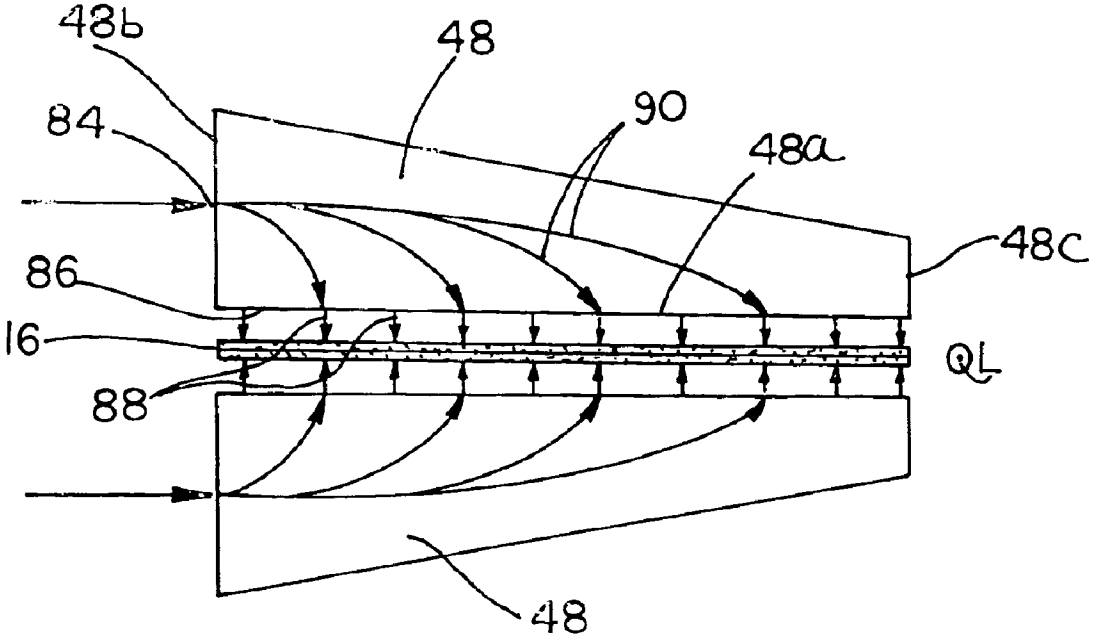
PRIOR ART FIG. 9
FIG. 9 is a schematic cross-section of a coating apparatus employing a gas distributor of the prior art.

FIG. 9 is a schematic cross-sectional view along a section IX—IX in FIG. 1, wherein the depiction of the gas suction hoods of turning unit 44 and stabilizing unit 50 is omitted. FIG. 9 shows an arrangement of gas distributors 48 of the prior art through which gas flows towards a double-coated web 16. Since the arrangement of gas distributors 4S is axially symmetric, only upper gas distributor 48 will be described in the following.

Web 16 in FIG. 9 is seen in cross-sectional view, wherein moving direction L of web 16 extends perpendicularly to the drawing plane towards the viewer. Elongated gas distributor 48 extends parallel to and essentially over the entire width of web 16. Gas distributor 48 exhibits a gas intake 84 on one side. From gas intake 84, gas, e.g. air, flows into the inside of gas distributor 48 and is discharged by a gas exhaust 86 which is located at a gas exhaust section 48*a* of gas distributor 48. Gas exhaust section 48*a* is a wall section of gas distributor 43 parallel to and facing moving web 16. Gas intake section 48*b* of gas distributor 48 of the prior art is formed by a wall section of a side wall. The height of gas distributor 48 decreases from gas intake section 48*b* to end section 48*c* of gas distributor 48, opposing gas intake section 48*b* in longitudinal direction of gas distributor 48 in order to try to keep the amount of gas flowing out of gas exhaust section 48*a* constant along gas distributor 48. Gas flowing towards web 16 is indicated by arrows 88. Gas flow occurring inside gas distributor 48 towards gas exhaust 86 is schematically indicated by arrows 90.

Figure 10:
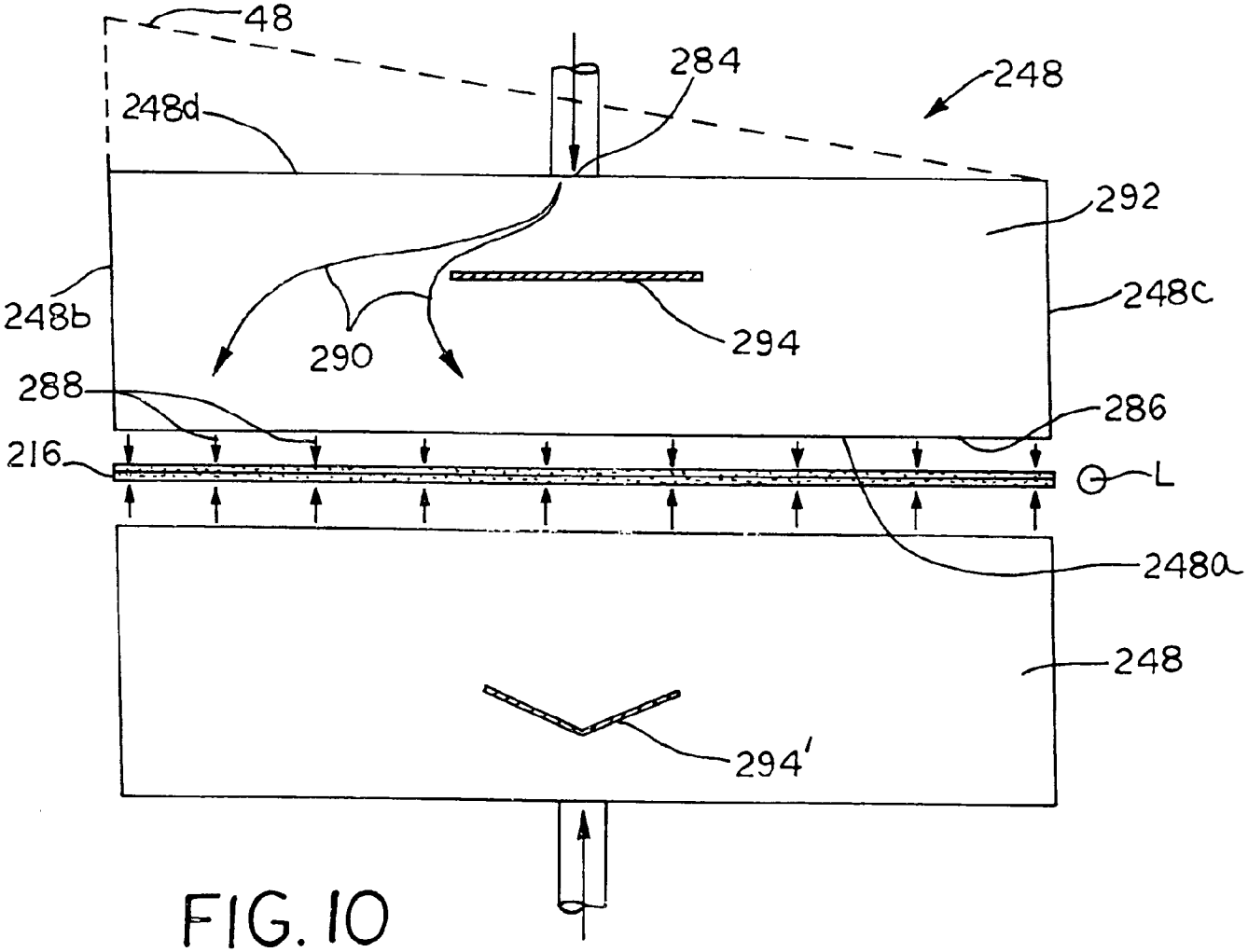
FIG. 10 is a schematic cross-section of a coating apparatus employing a gas distributor in accordance with the present invention.

FIG. 10 is a schematic cross-sectional view of a section along the line X—X in FIG. 3 with a variance in the gas distributors deployed therein. FIG. 10 shows an arrangement with improved as distributors 248 of the present invention.

In FIG. 10 the same components as in FIG. 9 are marked with the same reference numbers, however, increased by 100. In the following only the upper one of gas distributors 24S shown in FIG. 9 will be described. The description thereof also applies to the lower one of gas distributors 248.

Gas distributor 248 is essentially formed of an elongated, hollow parallelepiped body 292, gas distributor 248 extending in the longitudinal direction thereof over the entire width of web 216. Hollow body 292 exhibits a gas exhaust 286 on its bottom side facing web 216. The bottom side is thus gas exhaust section 248*a*. In upper side 248*d* opposite gas exhaust section 248*a* of gas distributor 248, in the area of the longitudinal center thereof, there is a gas intake 284. Inside gas distributor 248 there is a breaker plate 294 parallel to gas exhaust section 248*a* spaced apart below gas intake 284 in the longitudinal center of gas distributor 248. Breaker plate 294 avoids a short circuit of the gas exhaust nozzles (not specifically shown) arranged in direct prolongation to and with gas intake 284. The gas inside gas distributor 248 has to flow around breaker plate 294 as indicated by arrows 290 on the left side of gas distributor 248. Thus, a harmonized gas exhaust flow 288 along the length of gas distributor 248 is achieved. The breaker plate can also have the form of an arrow (i.e., an angled set of plates) as indicated by breaker plate 294' of lower gas distributor 248. As an option, breaker plate 294, 294' inside gas distributor 248 could be omitted.

The advantage of gas distributor 248 compared with gas distributor 48 of the prior art shown in FIG. 9 is its reduced construction height. Assuming that the height of end section 248*c* is determined by the amount of gas flowing therefrom, the height of gas distributor 48 of the prior art would increase linearly in the longitudinal direction thereof starting from end section 243*c* to opposite end section 248*b*. An outline of a conventional gas distributor of the same length is indicated in FIG. 10 by a broken line.

Figure 11:
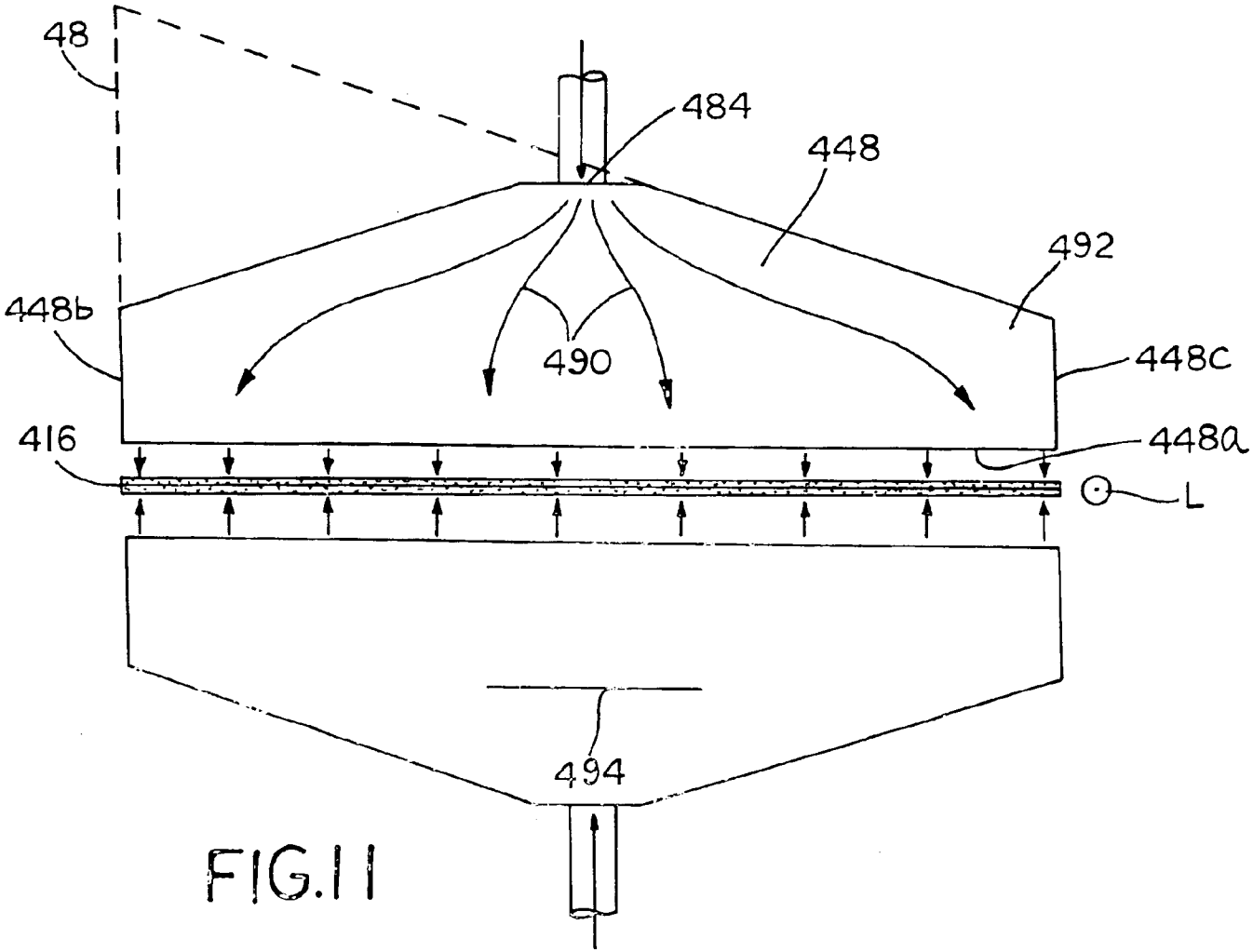
FIG. 11 is a schematic cross-section of a further embodiment of the gas distributor of the invention.

FIG. 11 shows an arrangement of gas distributors 448 which are used in drying units 442 and 466 of FIG. 5. The same components as in FIG. 10 are marked with the same reference numbers, however, increased by 200. As in FIG. 9 and 10, in FIG. 11 only upper gas distributor 44S is described and only insofar as it differs from gas distributor 24S shown in FIG. 10.

Gas distributor 448 is designed in such a way that its height or rather the height of the inner flow-relevant cross-section of gas intake 484 thereof near the longitudinal center of gas distributor 448 decreases towards end sections 448*b* and 448*c* thereof. The decrease of the height of the flow-relevant cross-section at any given longitudinal position corresponds to the amount of gas discharged from gas distributor 448 at this longitudinal position. This means that a per path increment from a given longitudinal position towards closest longitudinal end 448*b* or 443*c*, the height of gas distributor 448 decreases proportionally to the amount of gas exhausted along the path increment. Assuming, as in FIG. 10, that the cross-section area of end section 448*c* of gas distributor 448 is proportional to the amount of gas flowing out of end section 448*c* and thus has accordingly a fixed height, an equally working gas distributor 48 of the prior art would result whose outline is shown in broken lines in FIG. 11. One can see that gas distributor 448 shown in FIG. 11 has an essentially lower construction height than an equally working gas distributor 48 of the prior art, thus saving construction space.

The gas flow inside gas distributor 448 is indicated by arrows 490. In addition, the gas distributor 448 can be provided with a breaker plate 494, as shown in lower gas distributor 448 in FIG. 11.

FIGS. 12–15 show embodiments of drying units or turning units as can be used in coating apparatuses of the present invention.

Figure 12:
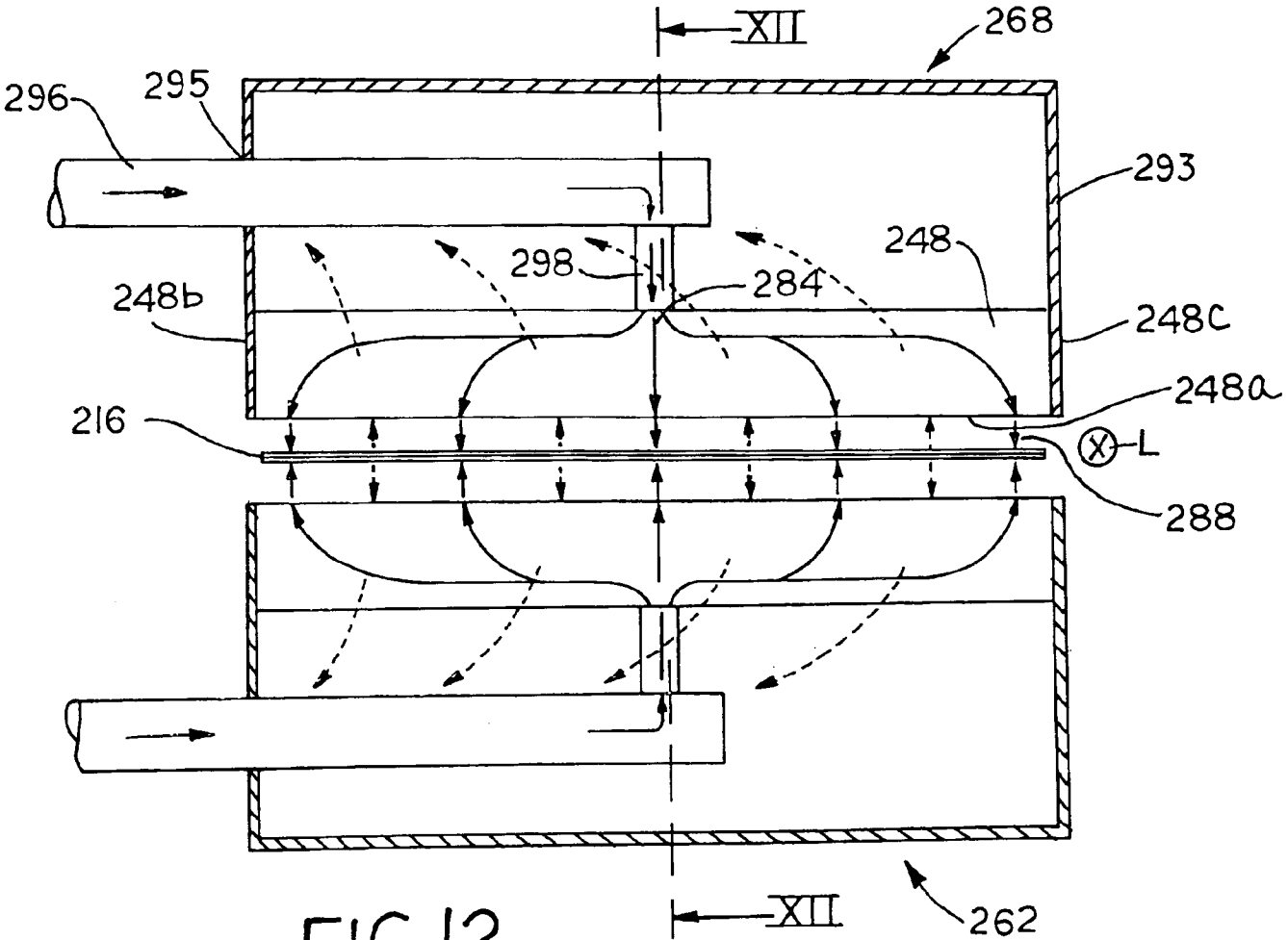
FIG. 12 is a schematic longitudinal section of two constructionally equivalent drying and turning apparatuses of the invention.

FIG. 12 shows a schematic cross-sectional view through the drying units 262 and 268 along the line XII—XII of FIG.

3. In the following only upper drying unit 268 will be described since the construction of lower drying unit 262 is a mirror image of and hence corresponds to upper drying unit 268. The mirror image refers to a reflection at the plane of web 216.

Drying, unit 268 exhibits a gas suction hood 293 in which a plurality of gas distributors 24S are arranged parallel to each other in longitudinal direction. End sections 248*b* and 248*c* of gas distributors 248 are in contact with the inside of gas suction hood 293. Via this contact gas distributors 248 are attached to gas suction hood 293 by, e.g., welding, screwing, riveting or glueing. A gas supply line 296 is introduced to the inside of drying unit 268 through an opening 295 in gas suction hood 293. A plurality of distribution lines 298 lead from gas supply line 296 to gas distributors 248, supplying gas thereto. Gas flows along the solid-line arrows via gas supply line 296 through gas distribution lines 298 to gas distributors 248. From there the gas flows from gas exhaust section 248*a* and hits the surface of web 216 as indicated by arrows 288. There, exhaust gas flow 288 absorbs humidity in form of water and/or solvent and is sucked off by a gas exhaust opening 299 (not shown in FIG. 12) along the dotted-line arrows. Gas exhaust opening 299 is on the level of gas supply line 296, however, behind the drawing plane of FIG. 12. In FIGS. 12–15, the solid-line arrows generally indicate drying air blown onto web 216 and the dotted-line arrows indicate the humid and/or solvent-containing exhaust air sucked off the surface of web 216.

Figure 13:
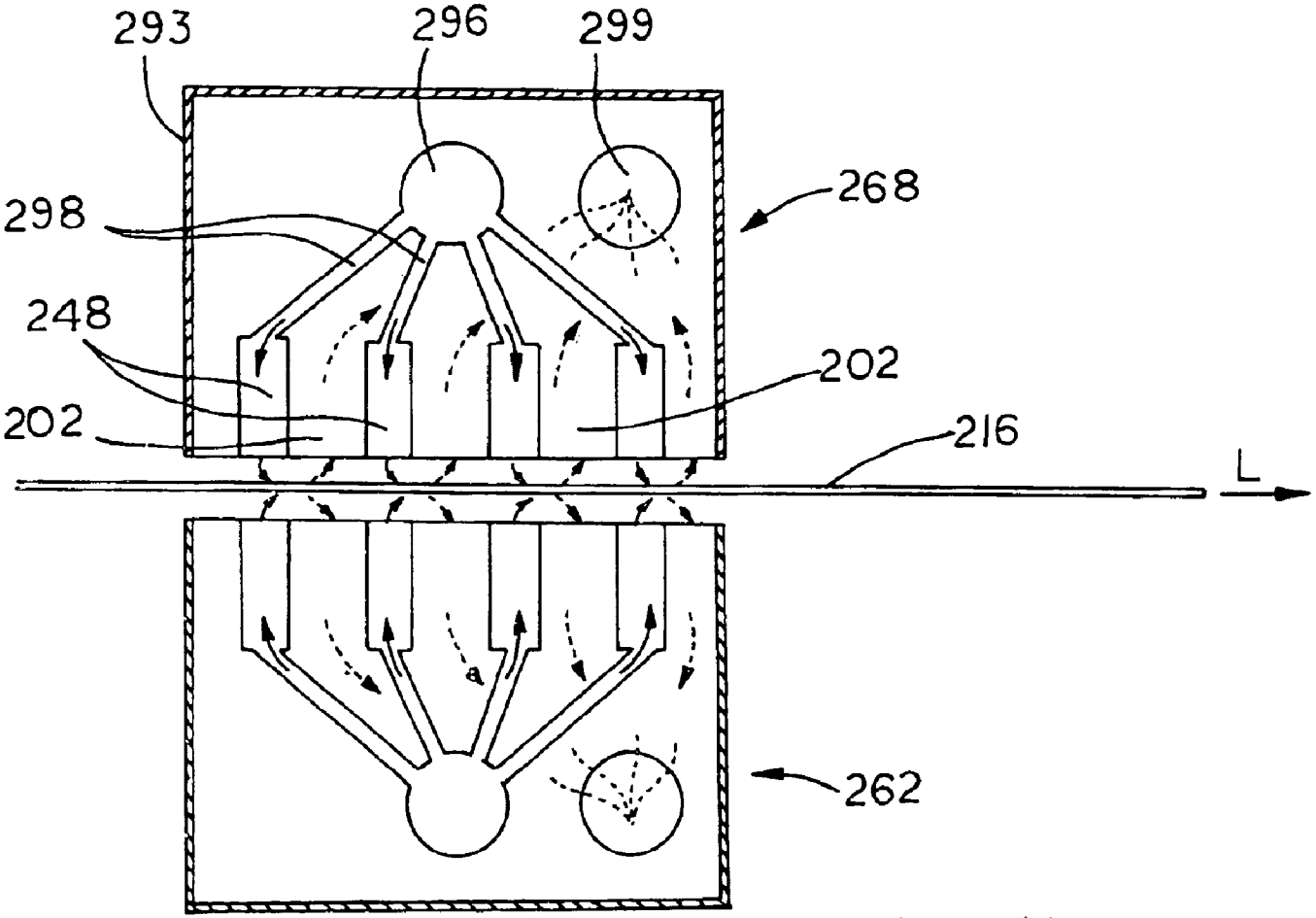
FIG. 13 is a schematic cross-section of the drying and turning, apparatus of FIG. 12, wherein the cross-section is along the line XIII—XIII of FIG. 12.

In FIG. 13 gas exhaust opening 299 can be seen more clearly. FIG. 13 is a section through drying units 262 and 268*a* along the line XIII—XIII of FIG. 12. In FIG. 13 gas exhaust opening 299, which is attached to a gas exhaust line (not shown) is shown on the right side next to the cross-section of gas supply line 296. In FIG. 13 it can also be seen that gas distributors 248, which are parallel to each other with respect to their longitudinal directions, are spaced apart in moving direction L of web 216 such that humid and/or solvent-containing exhaust gas or exhaust air can be sucked off from spaces 202 formed by this arrangement. Further, first and last gas distributors 248 with respect to moving direction L are spaced apart from the wall of gas suction hood 293 in order to create more spaces through which the exhaust gas or exhaust air can be sucked off the surface of web 216.

In FIG. 13 it can further be seen that gas distributors 248 of drying unit 268 and gas distributors 24S of drying unit 262 are arranged in pairs opposite to each other at the same respective longitudinal positions in moving direction L of web 216. A stable air cushion is thereby formed above and underneath web 216 which hardly affects web 216 mechanically since the forces of the air flow compensate each other mutually.

Figure 14:
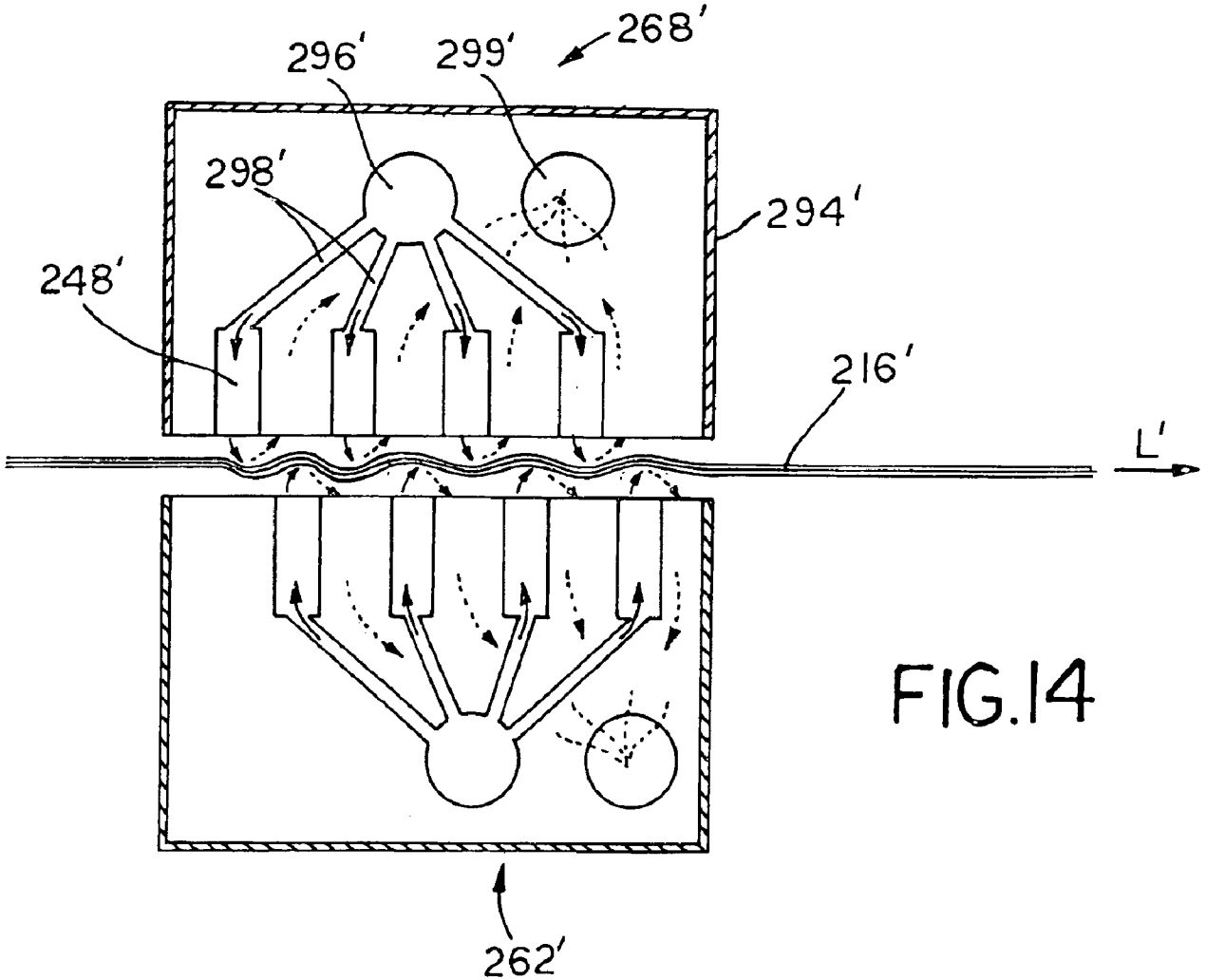
FIG. 14 is a schematic cross-section of a further embodiment of two drying and turning apparatuses according to the invention with an alternating arrangement of the gas distributors.

FIG. 14 shows an alternative arrangement of gas distributors in the upper and lower drying unit. The only difference to the gas distributors 248 of FIG. 13 is that gas distributors 248' of drying unit 268' of FIG. 14 are arranged opposite to each other on different sides of web 216', however, alternatingly in moving direction L' of web 216'. That means that a axed point of web 216' traveling through drying units 262' and 268' is affected by drying air on both sides by gas distributors 248' of drying unit 268' and of drying unit 262'; alternatingly.

In this arrangement of gas distributors 248', the flow forces from gas distributors 248' of the different sides of web 216' do no longer compensate each other such that web 216' forms waves which enlarge the surface of web 216' to be dried by drying units 262' and 268'. The driving performance of drying units 262' and 268' is thus increased.

Figure 15:
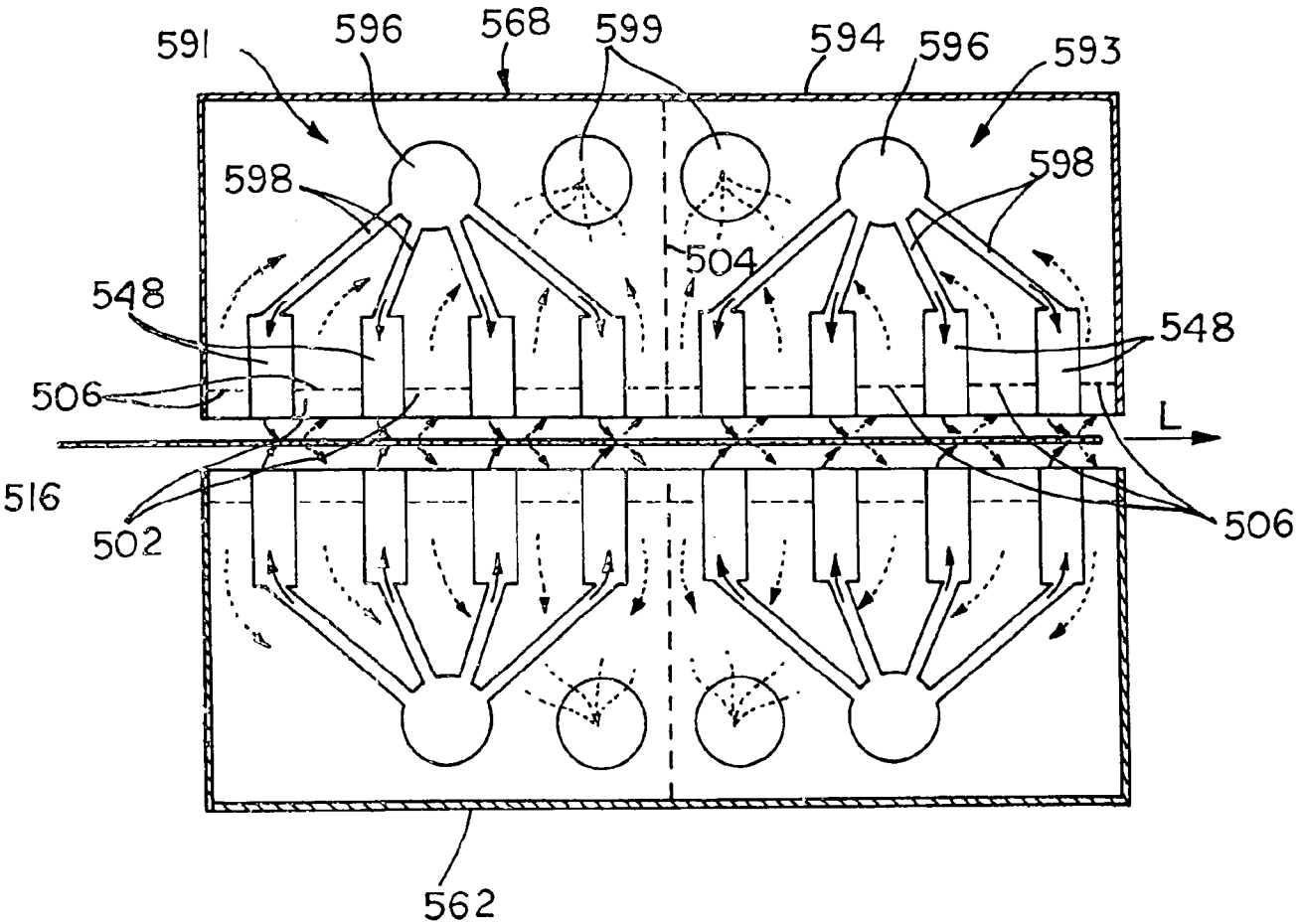
FIG. 15 is a schematic cross-section of a further embodiment of two drying and turning apparatuses, wherein the gas distributors of each apparatus are divided into groups.

FIG. 15 is a longitudinal section of drying units 562 and 568 shown in FIG. 6, corresponding to FIGS. 13 and 14. FIG. 15 shows an alternative embodiment of a drying unit 562, 568. In FIG. 15 the same components as in FIG. 13 are marked with the same reference numbers, however, increased by 100. Since drying units 562, 568 are symmetric, only upper drying unit 568 will be described. Its description also applies to the lower drying unit 562. In the following, FIG. 15 is only described insofar as it differs from FIG. 13. Its description is explicitly referred to heretowith.

Two groups 591 and 593 of gas distributors 54S are contained in gas suction hood 594. A gas supply line 596 with corresponding distribution lines as well as a gas exhaust opening 599 are each allocated to a respective group 591, 593 of gas distributors 548. This way long drying and/or turning units with long radii can be realized, and it can be guaranteed that all gas distributors 548 are supplied with sufficient drying gas. Between groups 591, 593, there is a vertical perforated plate 504 running across the entire cross-sectional area of gas suction hood 594, allocating one gas room for sucking off exhaust gas to each gas exhaust opening 599 by providing an increased flow resistance between groups 591, 593. Providing a perforated plate instead of a solid partition has the result that, in case of a total breakdown of one of the two gas exhaust lines connected to gas exhaust openings 599, the negative pressure present in the gas room of still working gas exhaust opening 599 can expand to the gas room of broken-down gas exhaust opening 599, thus guaranteeing that the apparatus works even in cases of the aforementioned malfunctions. In addition, a flow equalizer in the form of a perforated plate 506 is provided between spaces 502 between gas distributors 548 and between spaces 502 between one wall of gas suction hood 594 and a gas distributor 548 in order to homogenize the sucking off of humid and/or solvent-containing exhaust gas from the surface of web 516 over the length of drying unit 568.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for coating a moving fiber web on at least one side thereof with a coating material, the coating material being one of liquid and pastous, the moving fiber web having a web moving direction associated therewith, said apparatus comprising:

a coating station for applying the coating material onto the web, the fiber web leaving said coating station at a coating station exit point; and a non-contact turning apparatus following said coating station, relative to the web moving direction, the fiber web entering said non-contact turning apparatus at a tuning apparatus entry point, said coating station and said non-contact turning apparatus being conjunctively configured such that the fiber web moves substantially in only one plane between said coating station exit point and said turning apparatus entry point without changing direction, said non-contact turning apparatus including a first turning unit, the fiber web having a turning section, the turning section of the fiber web including a concave side, said first turning unit being structured and arranged for positioning thereof adjacent the concave side of the fiber web.

2. The coating apparatus of claim 1, wherein said coating station is configured for causing the fiber web to exit therefrom in an upward direction.

3. The coating apparatus of claim 2, wherein said upward direction is an essentially vertical direction.

4. The coating apparatus of claim 2, wherein said coating station is configured for causing the fiber web to exit therefrom in a downward direction.

5. The coating apparatus of claim 1, wherein said non-contact turning apparatus is configured for turning the fiber web by approximately 90°.

6. The coating apparatus of claim 1, wherein said non-contact turning apparatus is configured for turning the fiber web by approximately 180°.

7. The coating apparatus of claim 1, wherein said coating apparatus has a machine running direction associated therewith, said non-contact turning apparatus being configured for first turning the fiber web in said machine running direction.

8. The coating apparatus of claim 1, further comprising at least one non-contact drying unit, each said non-contact drying unit being arranged one of in front of and behind said first turning unit, relative to the web moving direction.

9. The coating apparatus claim 1, wherein said non-contact turning apparatus further includes a stabilizing unit, the turning section of the fiber web having a convex side in addition to the concave side thereof said stabilizing unit being positioned opposite said first turning unit, said stabilizing unit being structured and arranged for positioning thereof adjacent the convex side of the turning section of the fiber web.

10. The coating apparatus of claim 8, wherein at least one said drying unit is an infra-red dryer.

11. The coating apparatus of claim 8, wherein said at least one non-contact drying unit includes at least a first non-contact drying unit and a second non-contact drying unit, said first non-contact drying unit being arranged opposite said second non-contact drying unit, relative to the fiber web.

12. The coating apparatus of claim 8, wherein at least one said drying unit is an air dryer.

13. The coating apparatus of claim 1, wherein said coating station includes at least one of at least one direct coating unit for directly applying the coating material onto the fiber web and at least one indirect coating unit for indirectly applying the coating material onto the fiber web.

14. The coating apparatus of claim 1, wherein at least one further non-contact tuning unit is provided, said at least one further non-contact turning unit following said first non-contact turning unit, relative to the web moving direction.

15. The coating apparatus of claim 14, wherein at least one of said first non-contact turning unit and said at least one further non-contact turning unit has a source of a gas associated therewith, said gas being warmer than an ambient atmosphere surrounding the fiber web.

16. The coating apparatus of claim 14, further comprising at least one non-contact drying unit, each said non-contact unit being arranged one of in front of and behind said first turning unit, relative to the web moving direction, at least two of said first non-contact turning unit, said at least one further non-contact turning unit and said at least one non-contact drying unit being located at least one of within and under one common housing.

17. The coating apparatus of claim 16, wherein said one common housing is comprised of a plurality of housing parts.

* * * * *

UNITED STATES PATENT AND TRADEMARK OFFICE

CERTIFICATE OF CORRECTION

PATENT NO. : 6,895,690 B2
DATED : May 24, 2005
INVENTOR(S) : Helmer et al.

It is certified that error appears in the above-identified patent and that said Letters Patent is hereby corrected as shown below:

Column 1,
Line 47, delete “WO 93/32921”, and substitute -- WO 98/32921 --.

Column 2,
Line 64, delete “leasing”, and substitute -- leaving --.

Column 5,
Line 23, delete “20,”.

Column 8,
Line 29, delete “as”, and substitute -- gas --.

Column 9,
Line 29, after “turning” and before “apparatus”, delete “,”.

Column 10,
Line 15, delete “35a”, and substitute -- 38a --; and
Line 32, delete “43”, and substitute -- 48 --.

Column 11,
Line 51, delete “163”, and substitute -- 168 --.

Column 12,
Line 26, delete “244’”, and substitute -- 244 --; and
Line 48, delete “a”, and substitute -- α --.

Column 13,
Line 10, delete “37S”, and substitute -- 378 --;
Line 38, delete “413”, and substitute -- 418 --; and
Line 44, delete “373”, and substitute -- 378 --.

Column 14,
Line 25, delete “54S”, and substitute -- 548 --;
Line 52, delete “66’”, and substitute -- 662 --; and
Line 60, delete “5”, and substitute -- 8 --.

Column 15,
Line 23, delete “750”, and substitute -- 780 --;
Line 28, delete “as”, and substitute -- gas --;
Line 36, delete “4S”, and substitute -- 48 --;
Line 48, delete “43”, and substitute -- 48 --; and
Line 66, delete “24S”, and substitute -- 248 --.

UNITED STATES PATENT AND TRADEMARK OFFICE

CERTIFICATE OF CORRECTION

PATENT NO. : 6,895,690 B2
DATED : May 24, 2005
INVENTOR(S) : Helmer et al.

It is certified that error appears in the above-identified patent and that said Letters Patent is hereby corrected as shown below:

Column 16,
Line 28, delete “243c”, and substitute -- 248c --;
Line 35, delete “44S”, and substitute -- 448 --;
Line 37, delete “24S”, and substitute -- 248 --; and
Line 47, delete “443c”, and substitute -- 448c --.

Column 17,
Line 7, delete “24S”, and substitute -- 248 --;
Line 46, delete “24S”, and substitute -- 248 --; and
Line 59, delete “axed”, and substitute -- fixed --.

Column 18,
Line 13, delete “54S”, and substitute -- 548 --.

Column 19,
Line 30, following “apparatus”, insert -- of --; and
Line 33, following “thereof”, insert -- , --.

Signed and Sealed this

Seventh Day of February, 2006

JON W. DUDAS
*Director of the United States Patent and Trademark Office*